US009550108B2

(12) United States Patent
Blanchard

(10) Patent No.: US 9,550,108 B2
(45) Date of Patent: Jan. 24, 2017

(54) SKATEBOARD TRUCK WITH DYNAMIC ACTION ANGLE

(71) Applicant: Catapult Products, LLC, Salt Lake City, UT (US)

(72) Inventor: Daniel B. Blanchard, Bountiful, UT (US)

(73) Assignee: Catapult Products, LLC, Salt Lake City, UT (US)

( * ) Notice: Subject to any disclaimer, the term of this patent is extended or adjusted under 35 U.S.C. 154(b) by 0 days.

(21) Appl. No.: 14/432,663

(22) PCT Filed: Oct. 1, 2013

(86) PCT No.: PCT/US2013/062914

§ 371 (c)(1),
(2) Date: Mar. 31, 2015

(87) PCT Pub. No.: WO2014/055550

PCT Pub. Date: Apr. 10, 2014

(65) Prior Publication Data

US 2015/0265907 A1 Sep. 24, 2015

Related U.S. Application Data

(60) Provisional application No. 61/709,010, filed on Oct. 2, 2012.

(51) Int. Cl.

| | |
|---|---|
| ***A63C 17/01*** | (2006.01) |
| ***A63C 17/02*** | (2006.01) |
| ***A63C 17/00*** | (2006.01) |

(52) U.S. Cl.
CPC ..... *A63C 17/0093* (2013.01); *A63C 17/012* (2013.01); *A63C 17/02* (2013.01)

(58) Field of Classification Search
CPC ..... A63C 17/01; A63C 17/02; A63C 17/011; A63C 17/012; A63C 17/0093
See application file for complete search history.

(56) References Cited

U.S. PATENT DOCUMENTS

| | | | | |
|---|---|---|---|---|
| 4,184,693 | A | 1/1980 | Whitmarsh | |
| 8,251,384 | B1 | 8/2012 | Christensen et al. | |
| 2007/0182118 | A1* | 8/2007 | Cole | A63C 17/01 280/87.042 |

* cited by examiner

*Primary Examiner* — Bryan Evans
(74) *Attorney, Agent, or Firm* — Brian C. Trask

(57) ABSTRACT

A skateboard truck (200, 300), including a hanger (102", 102'") carrying an axle (104), and a baseplate (108", 108'"). The axle holds a pair of wheels, which are steered in unison by the axle. The baseplate is coupled to the hanger to permit hanger rotation about a dynamic hanger rotation axis (138"). A static mechanism (202, 302) enforces a static pivot point at a locus (111, 109') through which the dynamic hanger rotation axis passes during turning operation. Also, a dynamic mechanism (204, 402) causes the dynamic hanger rotation axis to pass through a plurality of dynamic hanger pivot points during that turning operation. Roll of the baseplate about a skateboard roll axis (152) is operable to cause a steering rotation of the axle, and also changes the action angle (150) of the truck.

20 Claims, 31 Drawing Sheets

SKATEBOARD TRUCK WITH DYNAMIC ACTION ANGLE

PRIORITY CLAIM

This application claims the benefit of the filing date of U.S. Provisional Application Ser. No. 61/709,010, filed Oct. 2, 2012, for "SKATEBOARD TRUCK WITH VARIABLE STEERING AXIS ANGLE".

TECHNICAL FIELD

This invention relates to steerable conveyances. Certain embodiments are particularly adapted for use in skateboarding.

BACKGROUND

Skateboard trucks generally include a hanger that carries an axle, and a baseplate. A pair of wheels are spaced apart at opposite ends of the axle. The hanger is coupled to the baseplate to permit hanger rotation about a pivot axis (the hanger rotation axis), and consequently, turn the skateboard. That is, the "hanger rotation axis" is defined as the pivot axis about which a hanger rotates with respect to its baseplate when change is made to a turn configuration. Conventionally, a pivot end of the hanger is held by a pivot bushing to permit rotation of the pivot end about a first static pivot point. A kingpin and pair of bushings permit rotation of the hanger about a second static pivot point located on the centerline of the kingpin. The first and second pivot points are regarded as "static" because they do not move relative to the base plate. The hanger rotates about a hanger rotation axis defined by the line extending through the first and second static pivot points. The "action angle" in such a conventional truck is defined as the angle between horizontal and the hanger rotation axis for a skateboard supported on a horizontal surface. The hanger rotation axis in that case is identical to an "axle normal axis", about which axle normal axis the axle moves in pure rotation (in a relative coordinate system) as a change is made in degree or amount of turn.

U.S. utility Pat. No. 8,251,384, to Christensen, et al., and titled "AXLE AND SUSPENSION" discloses an alternative skateboard truck. Embodiments structured according to this patent include an axle hanger that is constrained by a baseplate to oscillate in a single plane as the axle is displaced between maximum left and right turn configurations. The hanger rotates about a dynamic pivot axis, which moves relative to the baseplate. The dynamic pivot axis is defined by a rolling line contact between the hanger and a support surface. The "action angle" of these embodiments is defined as the angle between horizontal and a normal to the aforementioned plane for a skateboard supported on a horizontal surface. The "axle normal axis" of embodiments disclosed in the '384 patent is also normal to the aforementioned single plane, and is parallel to the dynamic pivot axis. The entire disclosure of this '384 patent is hereby incorporated as a portion of the instant disclosure as though set forth herein in its entirety.

One commercially available skateboard truck includes a hard turn stop intended to avoid wheel bite, wherein the board contacts a wheel during a hard turn. This hard turn stop is formed by an interference caused between a pair of set screws and the kingpin shaft. The set screws may be adjusted to determine an allowed amount of deck rotation before they contact the kingpin shaft. A complete description of this skateboard feature may be found on the world wide web at alphaskate.com/innovate/wheelbite.html, the entire disclosure of which is hereby incorporated for its teachings of various characteristics of skateboard trucks.

All known prior art skateboard trucks are structured in such a way that they inherently possess a constant action angle during the entire operation of the truck between maximum left and right turn configurations.

DISCLOSURE OF THE INVENTION

This invention provides an axle and suspension that may be used in a variety of conveyances, including skates, skateboards, scooters, wagons, carts, and the like. Conveyances may be powered by gravity alone, or may include an alternate source of propulsion. Although not currently preferred, certain embodiments may include means to control travel speed, such as a brake element, or a throttle.

Embodiments of the invention typically include an axle and a baseplate coupled to the axle. An operable axle is structured to span in a length axis direction between a pair of wheels such that the wheels are steered in unison by the axle. Generally, displacement of the axle is constrained by structure effective to cause steering rotation of the axle about a dynamic hanger rotation axis. During a turn maneuver between a maximum right turn position and a maximum left turn position, the dynamic hanger rotation axis passes through a static pivot point at a locus that is static with respect to the baseplate, and the dynamic hanger rotation axis passes through at least two instantaneous pivot points that are not co-linear with the static pivot point.

In an embodiment structured according to a Concept 1 version of the invention, the axle is carried by a hanger, and support structure carried by a baseplate is arranged to cooperate with pivot structure associated with a proximal end of the hanger effective to cause displacement, relative to the baseplate, of an instantaneous pivot point as the axle moves between a maximum right turn position and a maximum left turn position. In certain cases, the support structure includes a pivot bushing that confines, and interacts with, internally-disposed pivot structure of a hanger. It may be envisioned that alternative support structure may include a reversed arrangement. For example, alternative support structure of a baseplate may be confined inside pivot-enabling structure carried by a hanger, and the resulting mechanism may be operable to move a dynamic hanger rotation axis as degree of a turn angle is changed.

Operable pivot structure in a Concept 1 version may include a first pivot element and a second pivot element structured in harmony with the pivot bushing such that during change in a macro-turn in a first direction, the first pivot element defines a first instantaneous pivot point through which the dynamic pivot axis passes, and the second pivot element rotates around the first pivot element. In that embodiment, during change in a macro-turn in a second direction, the second pivot element defines a second instantaneous pivot point through which the dynamic pivot axis passes, and the first pivot element rotates around the second pivot element.

Certain embodiments of a Concept 1 version include first and second pivot elements that are journal mounted with respect to the hanger to permit their rotation about respective rotational axes. Those pivot elements may be structured in harmony with cooperating first and second detents in a socket carried by the pivot bushing such that the first pivot element may register with a first detent to define a location of a first instantaneous pivot point, and the second pivot element may register with the second detent to define a location of the second instantaneous pivot point. This type of embodiment may also include a third detent and a fourth detent. In that case, the third detent is desirably disposed to register with the second pivot element to define a maximum-turn configuration in the first direction. Further, the fourth detent is desirably disposed to register with the first pivot element to define a maximum-turn configuration in the second direction.

Sometimes, the pivot structure may also include a shelf. In that case, at least a portion of the shelf is desirably structured to cooperate with a portion of the pivot bushing effective to provide a micro-steering capability for the apparatus at an essentially zero-turn configuration of the axle.

Embodiments according to certain principles of the inventions may be structured and arranged to cause an increase in action angle in correspondence with an increase in steering rotation of the axle. Alternative embodiments may be structured and arranged to cause a decrease in action angle in correspondence with an increase in steering rotation of the axle.

An embodiment structured according to a Concept 1 version of the invention may include a kingpin anchored to a baseplate, with the static pivot point being disposed on the centerline of the kingpin. This type of embodiment also includes a hanger carrying the axle, where the hanger is anchored to the baseplate effective to permit rotation of the hanger about a dynamic hanger rotation axis.

Different embodiments of the invention may be configured to dispose a static pivot point, through which the hanger rotation axis passes, at a variety of different locations. For example, from the perspective of a support surface, a static pivot point defined by one embodiment is disposed between the centerline of the axle and a selected one of instantaneous pivot points through which the hanger rotation axis also may pass. From the same perspective, a static pivot point of an alternative embodiment is disposed on the opposite side of the centerline of the axle from a selected one of instantaneous pivot points through which the hanger rotation axis also may pass.

Certain embodiments of the invention may include a baseplate coupled to a hanger that carries the axle. From the perspective of a support surface, a static pivot point of an embodiment may be disposed closer to the inside end of that baseplate than a selected one of instantaneous pivot points through which the hanger rotation axis also may pass. Alternatively, from that same perspective, a static pivot point may be disposed closer to the outside end of the base plate than a selected one of instantaneous pivot points through which the hanger rotation axis also may pass.

An embodiment structured according to a Concept 2 version may include a hanger carrying an axle, and a baseplate defining a pair of spaced apart hanger pivot anchors effective to define a hanger pivot axis extending there-between. These embodiments also may include a yoke structured to allow a hanger to rotate around a separate hanger rotation axis, and a kingpin held by the yoke to dispose the kingpin centerline normal to the hanger pivot axis. Desirably, the hanger is structured to rotate about the kingpin centerline while maintaining dynamic contact with the baseplate. Therefore, sometime an embodiment may include means to urge dynamic contact between the hanger and structure associated with the baseplate in the absence of gravity-enforced contact.

Sometimes, embodiments may include a turn-limiting mechanism effective to provide a hard turn stop at maximum left turn and maximum right turn configurations. Preferably, such turn-limiting mechanism is structured to avoid making an interference-contact with the kingpin.

The invention may be embodied as a hanger carrying an axle, and a base plate coupled to the hanger effective to permit rotation of the hanger about a dynamic hanger rotation axis. Embodiments also include a static mechanism structured to enforce a static pivot point at a locus through which the dynamic hanger rotation axis passes during turning operation. Those embodiments also include a dynamic mechanism structured to cause the dynamic hanger rotation axis to pass through a plurality of dynamic hanger pivot points during that turning operation. Further, roll of the baseplate about a conveyance roll axis is operable to cause a steering rotation of the axle. Desirably, the dynamic mechanism is structured and arranged to cause a nonlinear change in turn angle responsive to change in tilt angle of the baseplate. Sometimes, the dynamic mechanism is structured and arranged to cause an increase in action angle in correspondence with an increase in steering rotation of the axle. The alternative situation is within contemplation.

Broadly, the invention may be embodied as a truck including a hanger carrying an axle, and a base plate coupled to the hanger effective to permit rotation of the hanger about a dynamic hanger rotation axis such that tilting the base plate around a conveyance roll axis causes a corresponding change in action angle of the truck while the dynamic hanger rotation axis passes through a static pivot point.

BRIEF DESCRIPTION OF THE DRAWINGS

In the drawings, which illustrate what are currently considered to be the best modes for carrying out the invention.

BEST MODES FOR CARRYING OUT THE INVENTION

Reference will now be made to the drawings in which the various elements of the illustrated embodiments will be given numerical designations and in which the invention will be discussed so as to enable one skilled in the art to make and use the invention. Similar structure is generally indicated by similar numerical designation. It is to be understood that the following description is only exemplary of the principles of the present invention, and should not be viewed as narrowing the claims which follow. While the instant description is made with reference to illustrations of embodiments structured for particular application to skateboards, the invention is not limited to such narrow application.

Further, the instant description is generally made with reference to theoretical construction and behavior, including theoretical pivot points, action angles, and axes of rotation, etc. Static and dynamic characterization is an important distinguishing element. It is recognized that, on a sufficiently small scale (such as microscopic), such behavior or characterization may not be strictly accurate. For example, the theoretical point contact between a ball bearing and its race is not truly point contact in a mathematical sense, but is more accurately characterized as area contact due to compressive deflections between the two interacting elements. However, from the vantage point of an unaided human observer, theoretical behavior is typically sufficiently accurate to characterize real-world behavior, and is operable (and is generally relied upon in this disclosure) to distinguish between various embodiments. In certain circumstances (e.g. micro-steering), real-world behavior is relied upon to characterize one or more aspect of an embodiment structured according to certain principles of the instant invention. It is believed that the application of real-world vs. theoretical behavior is easily deduced in context, if not pointed-out directly.

Figure 1A:
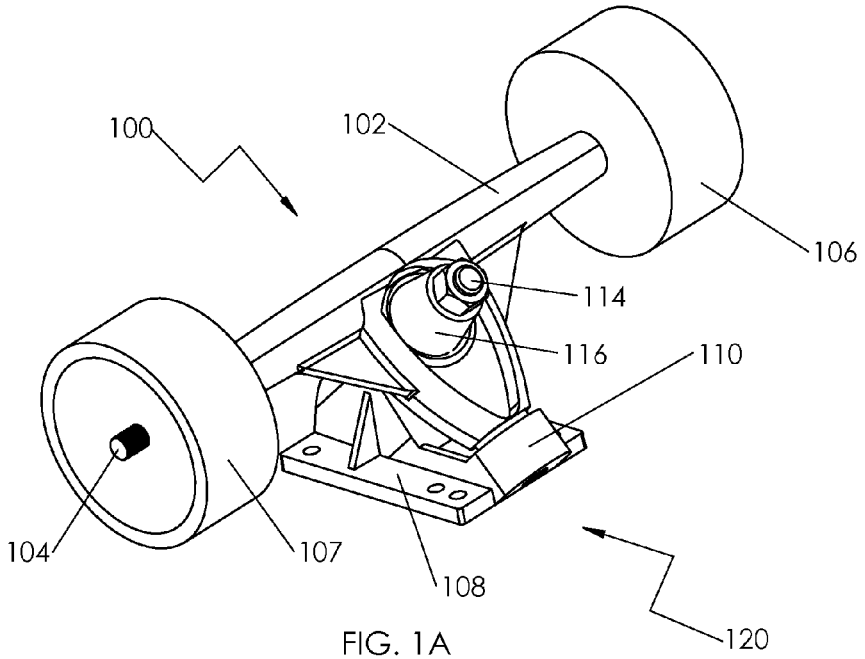
FIG. 1A PRIOR ART
FIG. 1A is a view in perspective of a prior art skateboard truck.
Figure 2A:
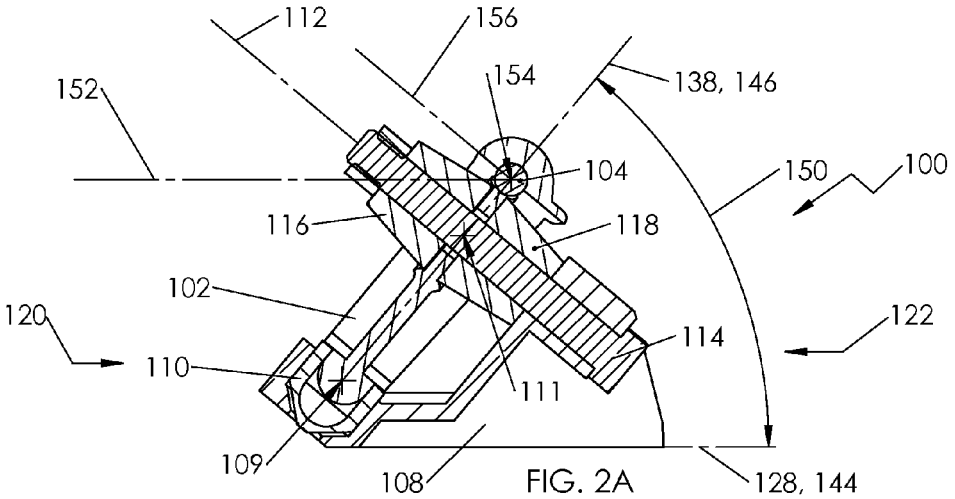
FIG. 2A PRIOR ART
FIG. 2A is a cross-section view taken through the centerline of the prior art skateboard truck in FIG. 1.

Certain nomenclature and design parameters applicable to embodiments structured according to certain principles of the invention will now be defined with reference to commercially available embodiments. As illustrated in FIGS. 1A and 2A, an exemplary prior art skateboard truck, generally 100, includes an axle hanger 102 that carries an axle 104 and spaces apart a pair of wheels 106 and 107. A baseplate 108 provides a first static pivot point, generally 109 (see FIG. 2), for hanger 102 that is disposed inside pivot cup 110. A second static pivot point, generally 111, for hanger 102 is defined on the centerline 112 of kingpin 114, and is typically on a mid-plane between top bushing 116, and a bottom bushing 118. The first pivot point 109 and second pivot point 111 are regarded as "static", because they do not move relative to the base plate 108.

Figure 1B:
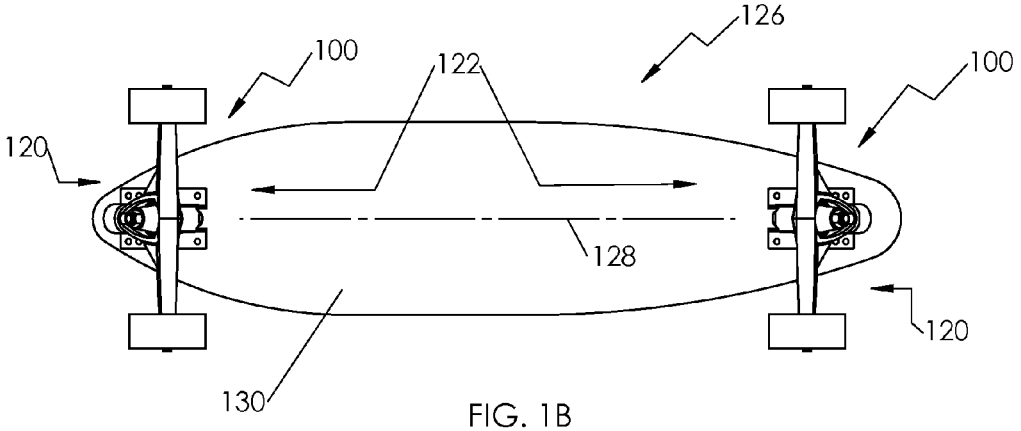
FIG. 1B PRIOR ART
FIG. 1B is a plan view of a skateboard bottom side including a pair of trucks from FIG. 1, and in a no-turn configuration.

Of note in the truck embodiment 100 is that the pivot cup 110 is disposed on the outside end, generally 120, of baseplate 108. That is, with reference to FIG. 1B, the front and rear trucks 100 are mounted such that their respective baseplates 108 have respective inside ends, generally 122, disposed to face each other to cause proper turning of the skateboard, generally 126 in FIG. 1B. The conventional skateboard 126 has a board length axis 128, which for convenience may be considered as being disposed on the bottom surface of exemplary flat deck 130.

Figure 1C:
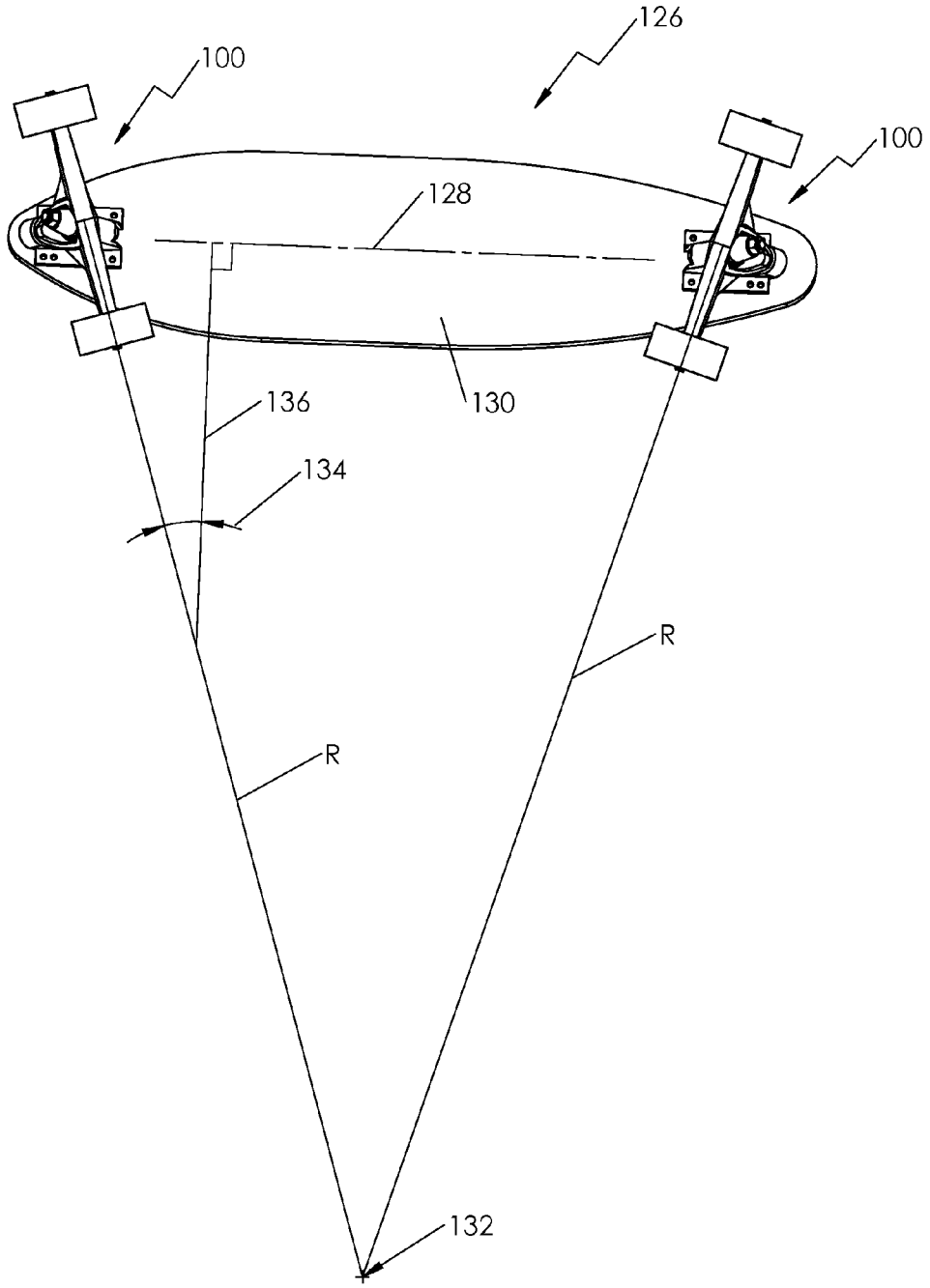
FIG. 1C PRIOR ART
FIG. 1C is a plan view of the skateboard in FIG. 1B, but in a turn configuration.

With reference now to FIG. 1C, a turn radius R of skateboard 126 extends from a turn center, generally 132, to approximately the kingpin 114. If front and rear trucks 100 are identical, the turn radius R is the same length for both of the front and rear trucks. A turn angle 134 is defined between a turn radius R and a vector 136 that is normal to the board length axis 128.

Figure 1D:
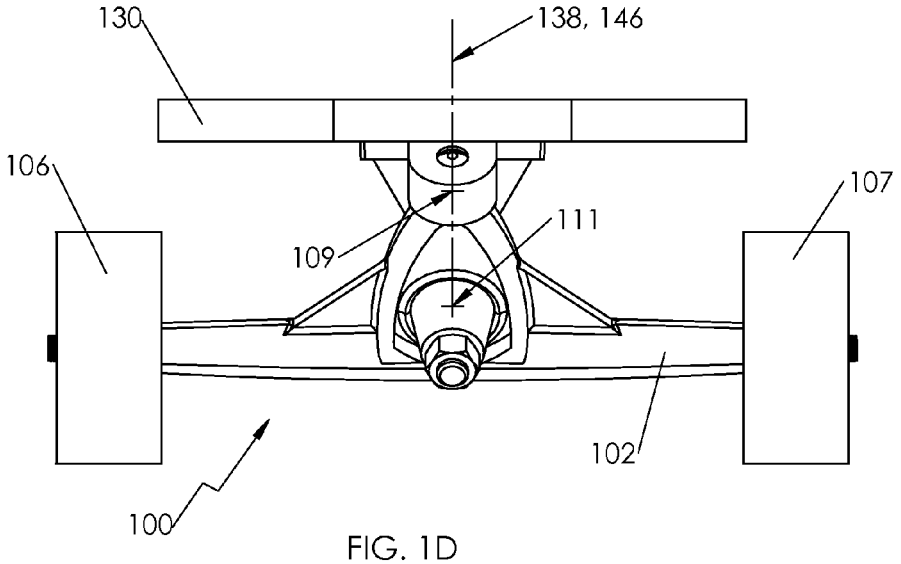
FIG. 1D PRIOR ART
FIG. 1D is an end view of the skateboard in FIG. 1C, at a zero-turn configuration.
Figure 1E:
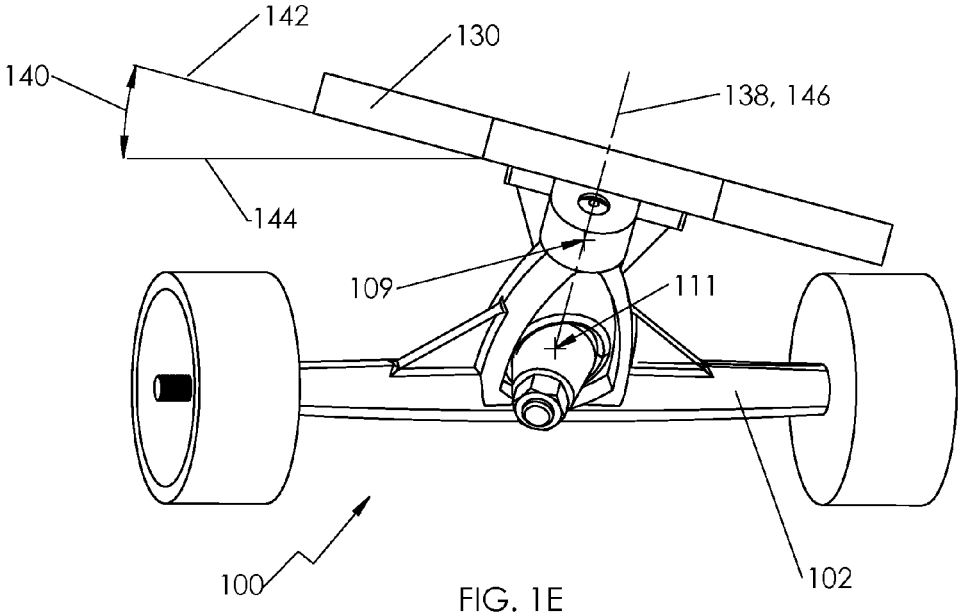
FIG. 1E PRIOR ART
FIG. 1E is an end view of the skateboard in FIG. 1C, at a sharp-turn configuration.

A hanger rotation axis 138 may be defined as that axis about which a hanger, such as hanger 102 in FIGS. 1D and 1E, rotates. Note that in FIG. 1D, hanger rotation axis 138 passes through static pivot points 109 and 111, and is disposed in a plane normal to the bottom surface of deck 130 (see any front view) and at a constant angle (see any side view). Because pivot points 109 and 111 are static, hanger rotation axis 138 remains fixed with respect to the deck 130, regardless of amount of turn induced by deck tilt angle 140. Therefore, hanger rotation axis 138 in FIGS. 1D and 1E may be characterized as a static axis. As illustrated in FIG. 1E, deck tilt angle 140 is defined as the departure from parallel between the plane 142 of deck 130 and a horizontal plane 144 (assuming wheels 106, 107 are rolling on a horizontal surface).

An important axis relating to an amount of steering of an axle 104 is the axle normal axis 146, which is always disposed normal to the axle 104. An "axle normal axis" may be defined as i) resident in a plane disposed perpendicular to the axle centerline and typically passing through the axle midpoint; and ii) is an axis of a relative coordinate system about which axis the hanger and axle exhibit pure rotation. Further, if the origin of the relative coordinate system is located at a static pivot point (e.g. 111), then the "axle normal axis" rotates about that static pivot point (from the frame of reference of a Global coordinate system) and the axle and hanger rotate about the "axle normal axis" (from the frame of reference of the relative coordinate system).

In certain cases, the axle normal axis 146 may pass through one or more static pivot point. For example, in embodiment 100, axle normal axis 146 may be defined as a line passing through pivot point 109 and pivot point 111. Sometimes, axle normal axis 146 may also pass through the center of axle 104 (e.g. if there is no positive or negative caster. Note that positive caster produces the tendency for the truck to stay centered. Negative caster produces the tendency of the truck to stay in a turn. Negative or positive caster is determined by the axle centerline being disposed either above or below the axle normal axis 146, respectively).

In the case of illustrated embodiment 100, the axle normal axis 146 is always coincident with the static hanger rotation axis 138. The hanger rotation axis 138 may be regarded as an axis in a coordinate system about which axis the hanger and axle exhibit pure rotation. An action angle 150 can be defined as the angle between a horizontal plane 144 and the axle normal axis 146 (best visualized for embodiment 100 in a side view, such as FIG. 2A). Action angle 150 generally corresponds to steering responsiveness vs. tilt angle. That is, a low action angle 150 correlates to a large turn radius for a given tilt angle (e.g. more stable at high speeds), and a larger action angle correlates with a smaller turn radius for the same given tilt angle.

With reference again to FIG. 2A, a conveyance roll axis 152 is defined as the line about which the board deck 130 tilts during a turn. The roll axis 152 passes through the axle centerline 154 and at least approximately mid-length point of each axle 104 of skateboard 126. Because the hanger rotation axis 138 is static, the axle 104 oscillates in an axle travel plane 156 that is normal to (extending 2-dimensionally transverse to) the static hanger rotation axis 138 (from the point of reference of a baseplate 108).

Figure 2B:
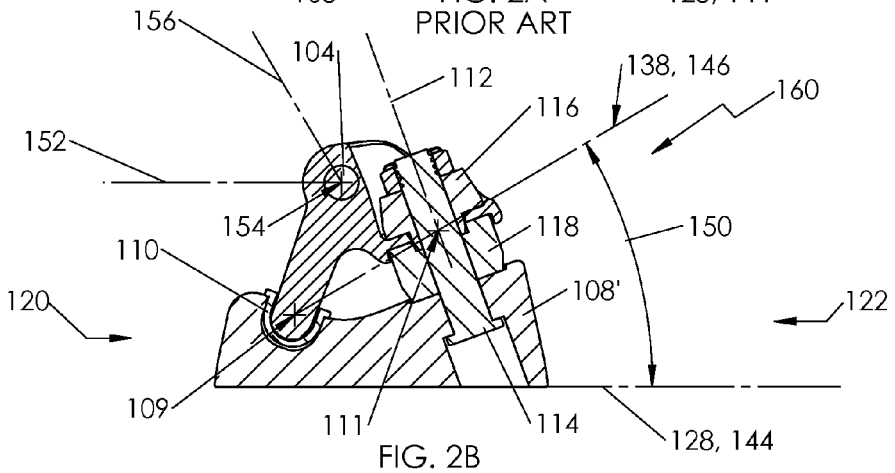
FIG. 2B PRIOR ART
FIG. 2B is a cross-section view taken through the centerline of another type of prior art skateboard truck.

Structure similar to that illustrated in FIG. 2A is illustrated in FIG. 2B for an alternative and commercially available skateboard truck, generally 160, and is denoted with similar numerals. Significantly, the static pivot point 111 is located closer to the inside end 122 than the static pivot point 109, and the axle is disposed between the pivot points 109 and 111. That is, the axle centerline 154 is disposed between the first static pivot point 109 of the hanger 102 and the second static pivot point 111 of the hanger 102 (from the point of view from the support surface on which a skateboard including truck 160 is rolling).

Figure 2C:
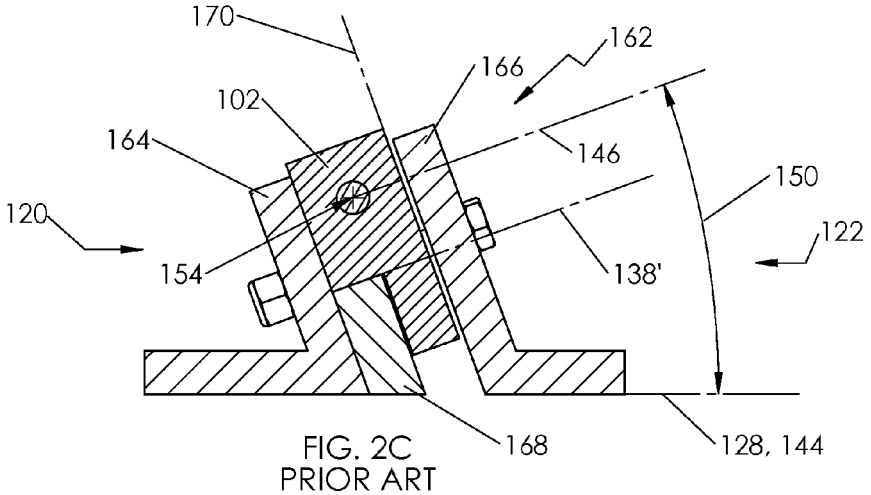
FIG. 2C PRIOR ART
FIG. 2C is a cross-section view taken through mid-location of yet another type of prior art skateboard truck.

FIG. 2C illustrates a skateboard truck, generally 162, according to the '384 patent in cross-section, and points out certain important corresponding axes and angles. Axle hanger 102 is confined between front plate 164 and rear plate 166, and oscillates about line contact on ramp 168. That line contact defines an instantaneous axis of rotation 138', generally in correspondence with the hanger rotation axis 138 in embodiments 100 and 160. Hanger 102 oscillates in a fixed plane 170 that is defined by walls 164 and 166. The axle normal axis 146 passes through the midpoint of the axle and intersects the centerline 154. In embodiments structured according to FIG. 2C, lines 154 and 138' are parallel, and can never intersect. An intersection could be formed (as coaxiality of the axes), if the ramp and hanger were alternatively structured to permit line contact 138' to sweep through the axle centerline 154.

FIGS. 3-22 illustrate certain aspects of embodiments structured according to a first concept of the instant invention (Concept 1). An exemplary embodiment of a skateboard truck according to Concept 1 is indicated generally at 200 in FIG. 3. Truck 200 includes a static mechanism, generally 202, effective to define a static pivot point 111, or locus, through which an instantaneous hanger rotation axis 138" passes. The location of an exemplary static pivot point 111 defined with reference to a kingpin 114 (which sometimes may be characterized as a kingpin pivot point) may be visualized with reference to FIGS. 2A and 2B.

Figure 3:
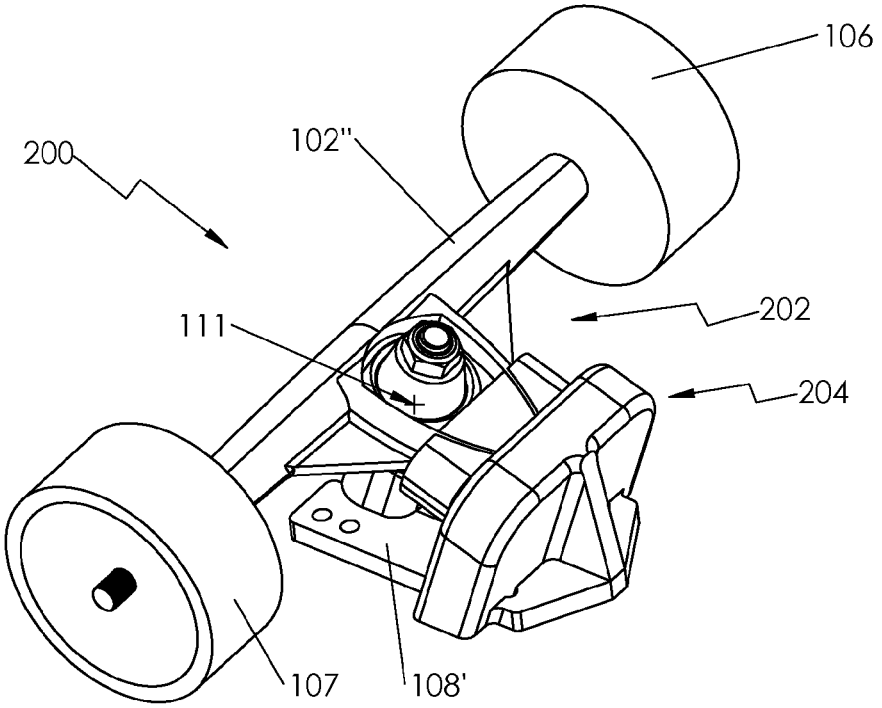
FIG. 3 is a view in perspective of a first embodiment structured according to certain principles of the invention.
Figure 4:
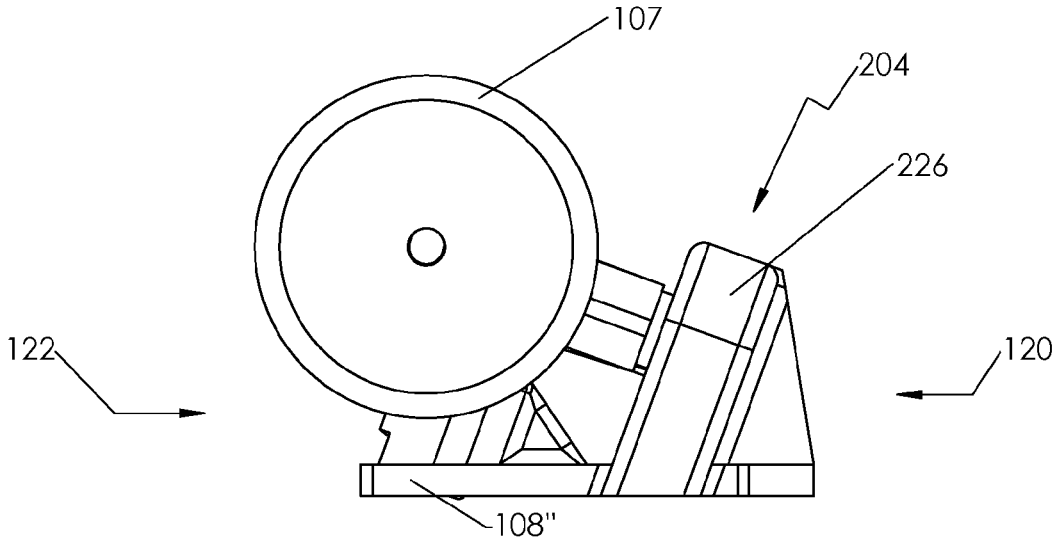
FIG. 4 is a side view of the embodiment in FIG. 3.
Figure 5:
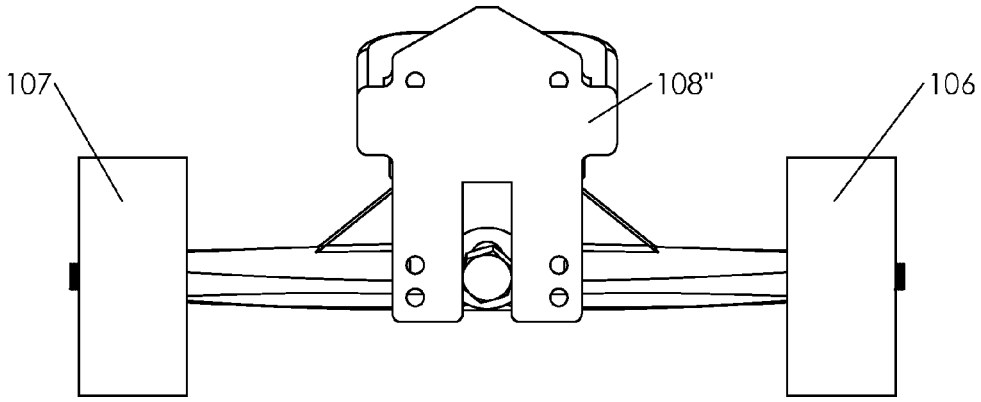
FIG. 5 is a bottom view of the embodiment in FIG. 3.
Figure 6:
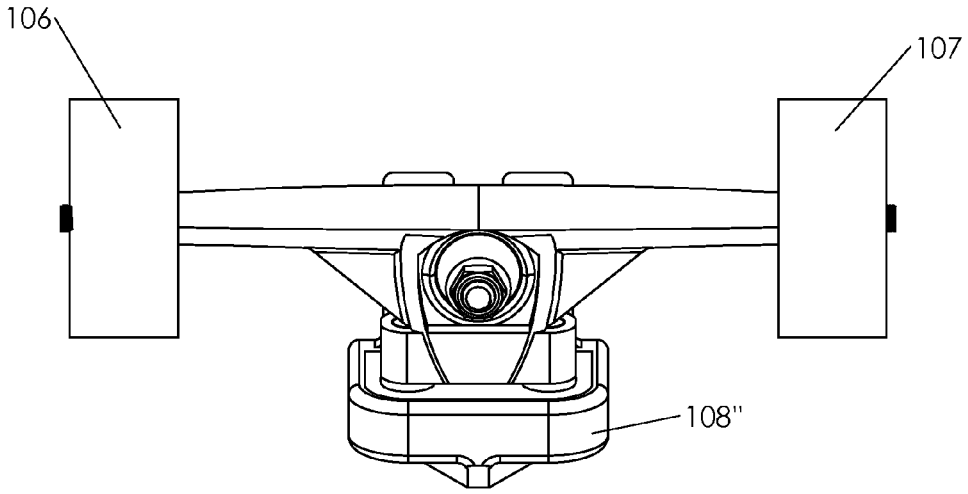
FIG. 6 is a top view of the embodiment in FIG. 3.

Truck 200 also includes a dynamic mechanism, generally 204, effective to define at least two instantaneous pivot points through which hanger rotation axis 138" may alternatively pass. Hanger 102" in FIG. 3 is a modified version of hanger 102 in FIG. 2A. The proximal end of hanger 102" is modified to interface with dynamic mechanism 204. Dynamic mechanism 204 may be regarded as causing an oscillation of the hanger rotation axis 138 about the static pivot point responsive to active steering of the axle.

Figure 7:
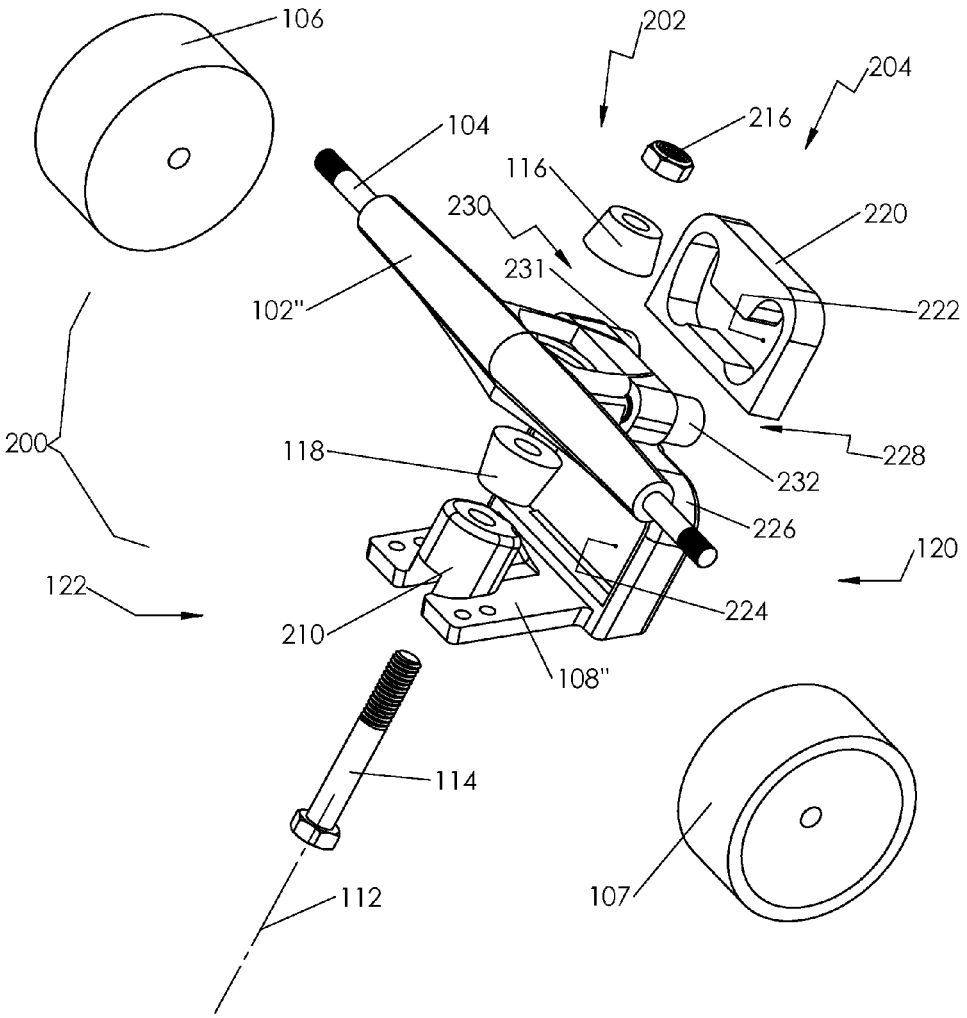
FIG. 7 is an exploded assembly view of the embodiment in FIG. 3.

The exploded view in FIG. 7 illustrates many constituent elements of a workable truck 200. The illustrated and exemplary static mechanism 202 includes a kingpin 114 anchored in a base 210 to resist rotation of the kingpin about its centerline 112. The illustrated static mechanism 202 can be structured substantially the same as would be employed in truck 100. As illustrated, the kingpin 114 may be assembled through the center of lower bushing 118, hanger 102", and top bushing 116. A nut 216 may be tightened to adjust resistance of truck 200 to tilting from a zero-turn configuration and about a conveyance roll axis.

With continued reference to FIG. 7, the illustrated and exemplary dynamic mechanism 204 includes a pivot bushing 220 that defines a socket 222. Pivot bushing 220 is held in a cooperating socket 224 formed in pivot base 226. Pivot base 226 is an integral element of baseplate 108". The proximal end 228 of hanger 102" carries pivot structure, generally 230. Illustrated pivot structure 230 includes a pair of pivot elements 231 and 232, respectively. Pivot elements 231 and 232 are desirably journal mounted to permit their rotation about respective axes of rotation, generally 233 and 234, respectively (see also FIG. 12).

Figure 8:
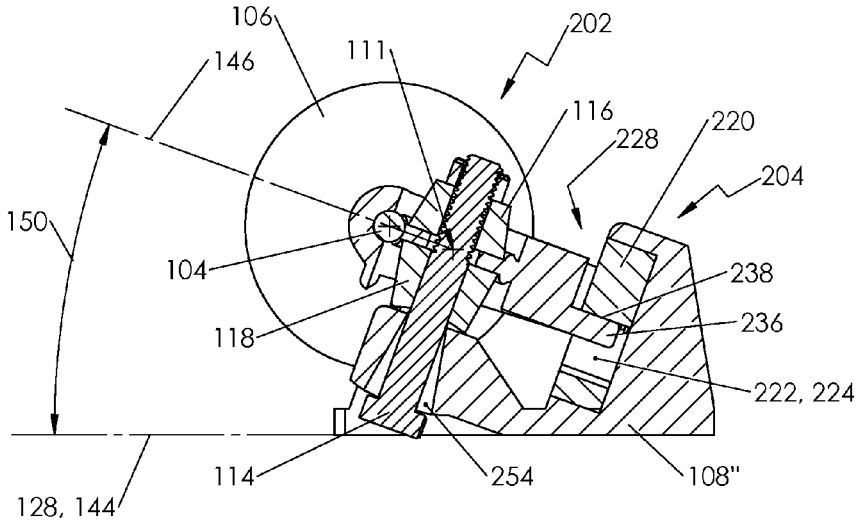
FIG. 8 is a cross-section view of the embodiment in FIG. 3.

With reference now to FIG. 8, proximal end 228 may also carry a shelf 236 adapted to interface in bearing contact with support structure 238 of bushing 220. Interaction between a bearing surface of shelf 236 and support surface 238 (or alternatively between pivot elements 231 and 232 and walls of socket 224 in pivot bushing 220), defines the initial action angle 150 (at a zero-turn configuration).

Figure 13A:
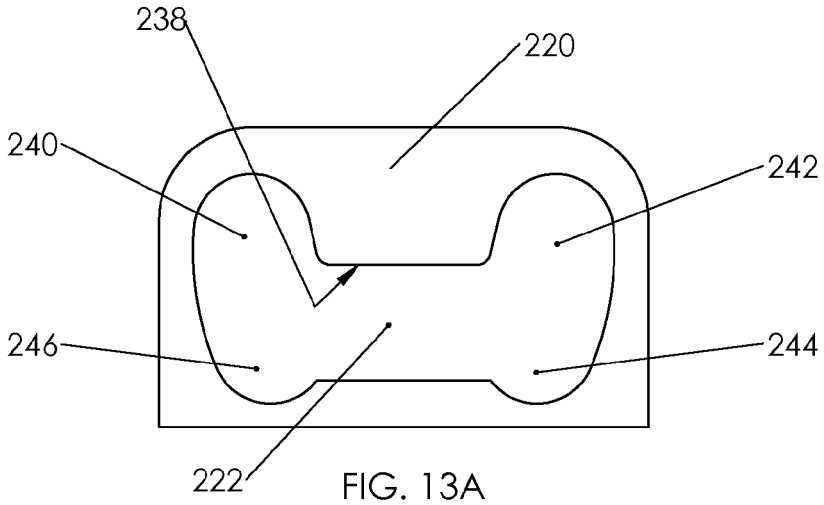
FIGS. 13A through 13C illustrate substitute bushing elements that may be used in the embodiment in FIG. 3.
Figure 13B:
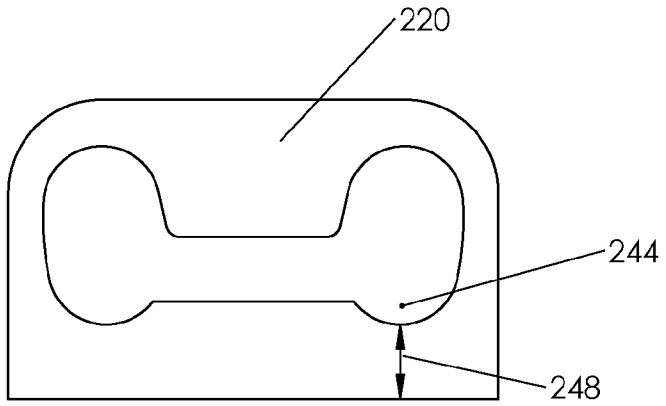
Figure 13C:
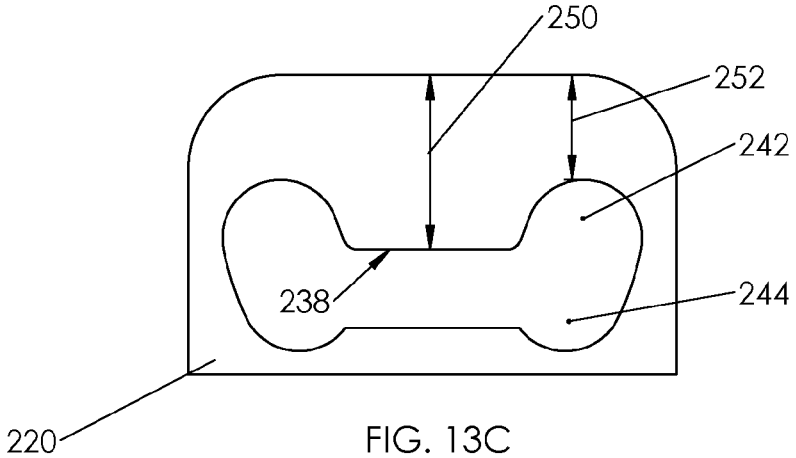

As illustrated in FIGS. 13A through 13C, a pivot bushing 220 may be replaced by an alternatively structured pivot bushing 220 effective to change the initial angle of action angle 150, and also to modify the amount of tilt angle between hard turn stop configurations. Sizes of elements in FIG. 13*a* through 13C are to scale, and may be directly compared to each other to compare structural features.

FIG. 13A illustrates a pivot bushing 220 that is structured to permit a 20 degree maximum board tilt, and to cause a 20 degree initial action angle 150. During a turn in a first direction, first detent 240 receives first pivot element 231, and defines a first pivot axis (the axis of rotation 233 about which pivot element 231 is journalled). During a turn in a second direction, second detent 242 receives second pivot element 232, and defines a second pivot axis (the axis of rotation about which pivot element 232 is journalled). Hanger 102" pivots about either pivot element, depending on selected turn direction.

At a first maximum permitted turn configuration in a first direction, pivot element 231 is held for rotation at a fixed position by detent 240 and pivot element 232 is received in third detent 244. Therefore, detent 244 cooperates with detent 240 to resist further rotation of the hanger 102" in that first direction. Such behavior is characterized as providing a hard turn stop. Similarly, a second hard turn stop is formed during a turn in the opposite direction when pivot element 232 is held by detent 242 for rotation about pivot axis 234, and pivot element 231 rotates about axis 234 until making contact with wall structure of detent 246.

With reference to FIG. 13B, the angle between zero-turn and maximum turn may be reduced by increasing a thickness 248 of wall structure, such as for detent 244. Consequently, pivot structure 232 will encounter a boundary defined by detent 244 at a lower deck tilt angle. The pivot bushing illustrated in FIG. 13B is structured to provide a 10 degree maximum deck tilt angle, and a 20 degree initial action angle.

With reference to FIG. 13C, increasing the spacing 250 for support surface 238 (or sometimes, thickness 252 for a wall of detent 242), increases the initial action angle 150 (see FIG. 8, where moving surface 238 causes a rotation of "axle normal axis" 146, which always passes through static pivot point 111). The pivot bushing illustrated in FIG. 13C is structured to provide a 15 degree maximum deck tilt angle, and a 24 degree initial action angle. Changes to the initial action angle 150 are desirably accommodated for by providing a slot 254 (see FIG. 8) to permit the king pin 114 to rotate (only in a vertical plane containing the board length axis) in accordance with changes in structure of pivot bushing 220. Such accommodation facilitates parallel top and bottom loading of the kingpin bushings 116, 118.

The illustrated cooperating surfaces of pivot elements, e.g 231, and a detent or socket, e.g. 240, are generally cylindrical. In an alternative arrangement within contemplation, the circumferential surface of a pivot element 231, 232 may be angled at varying radii, and arranged to dovetail with the cooperating surfaces of a detent, effective to resist decoupling of a dynamic mechanism 204.

Figure 9:
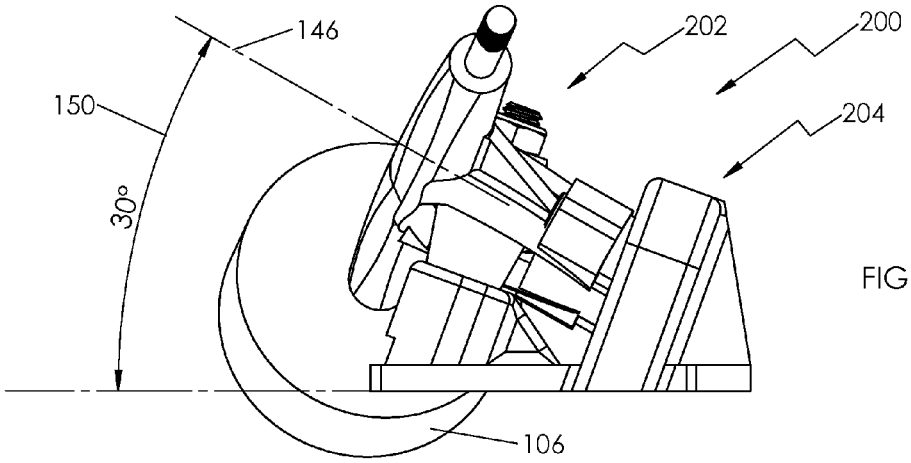
FIG. 9 is a side view of the embodiment in FIG. 3, with a wheel removed and at a hard-turn configuration.
Figure 10:
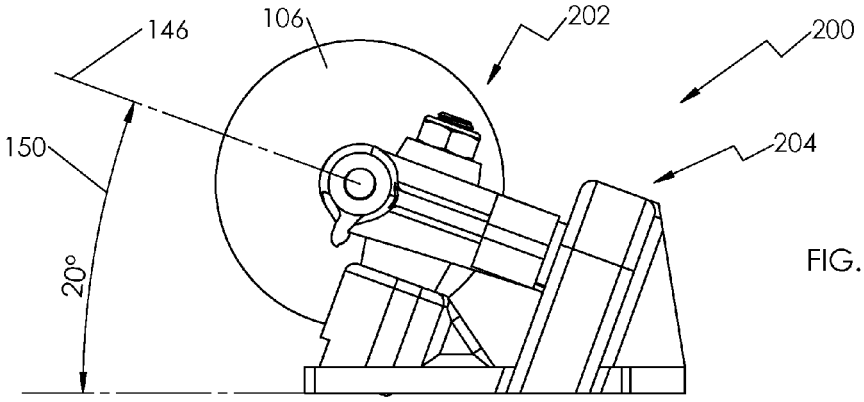
FIG. 10 is a side view of the embodiment in FIG. 3, with a wheel removed and at a zero-turn configuration.
Figure 11:
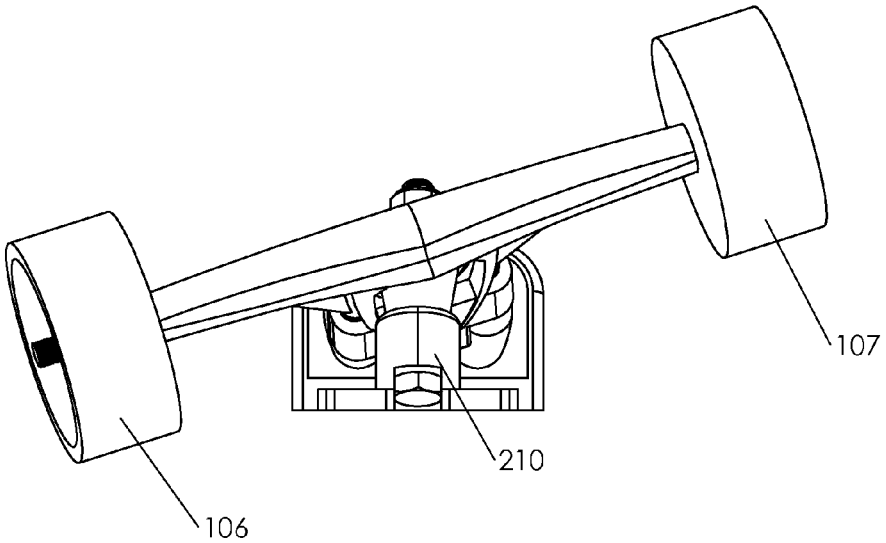
FIG. 11 is an end view of a portion of the embodiment in FIG. 3, in a maximum-turn configuration.
Figure 12:
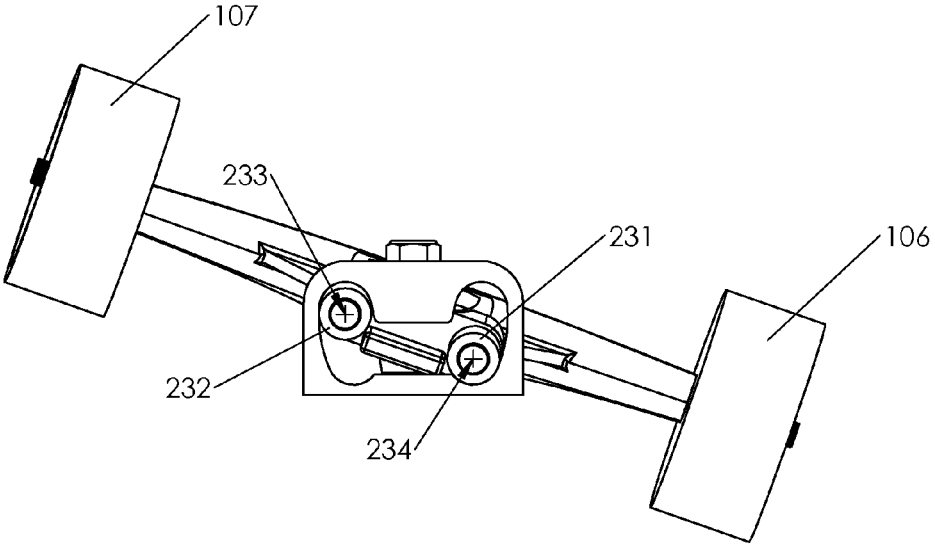
FIG. 12 is a view from the opposite end of the embodiment in FIG. 11, but with the baseplate removed.

FIGS. 9 and 10 illustrate a change in action angle 150 that may be effected by an embodiment structured according to certain principles of the invention. The action angle 150 in FIG. 9 is for a skateboard truck 200 in a hard-turn configuration. The action angle in FIG. 9 is 30 degrees. In comparison, FIG. 10 illustrates the same truck 200, but at a zero-turn configuration. In FIG. 10, the action angle 150 is 20 degrees. Therefore, the action angle 150 for a truck structured according to principles illustrated in FIGS. 9 and 10 may be characterized as "dynamic", or variable, as compared to the static, or constant, dynamic action angle 150 illustrated in FIG. 2A.

FIGS. 14A through 14E illustrate different structural aspects that may be present in a pivot bushing 220 suitable for use in an embodiment structured according to FIG. 3. In the currently preferred embodiment illustrated in FIG. 14A, support surface 138 includes a flat area adapted to interface with a corresponding flat surface 260 on shelf 236. If the pivot bushing 220 and shelf 236 are essentially rigid, interaction between shelf 236 and support surface 238 cooperate to define a sharp discontinuity in resistance to steering the truck. That is, a zone of resistance to turn from a zero-turn configuration is formed by that interaction. If bushing 220 possesses some resilience (which is generally desirable), a zone permitting control of micro-turning is established near the zero-turn configuration.

Micro-turning, or micro-steering, may be established by cooperating shapes of support surface 238 and 260, or by deflection (squashing) of corners 262 and 263 of the bushing 220. Micro-steering is what is done at high speeds to take large arc turns or going relatively straight, whereas the macro-steering is more for maneuvering, carving, turning quickly. For purpose of this disclosure, micro-turning is defined as typically in the +/−1 to +/−5 degree range for board tilt angle, where macro-steering, or macro-turning, generally encompasses a more significant 2-25 degree (or so) range for board tilt angle. Depending on the shape of the pivot bushing 220 and the shelf 236, the micro-steering could be as little as +/−1 degree, or less. Micro-steering in FIG. 14A occurs until the gap 264 is closed, and pivot element 232 is seated in its cooperating detent in pivot bushing 220. After that point, a continued change in turn radius enters the macro-steering genre.

Typically, the arcuate surface 266 of socket 220 is configured for rolling contact with pivot element 232, as pivot element 232 rotates about pivot axis 233. In that construction, the proximal end of hanger 102" resists "rattle" during change in a turn angle. Desirably, the bushing 220 is symmetrical about a vertical mid-plane.

Figure 14A:
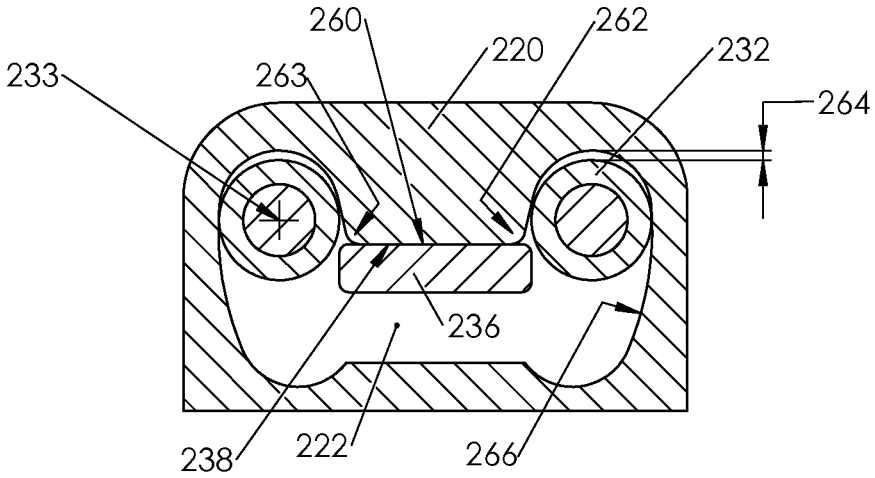
FIGS. 14A through 14E are cross-section views of substitute bushing, pivot, and suspension structure that may be used in the embodiment of FIG. 3.
Figure 14B:
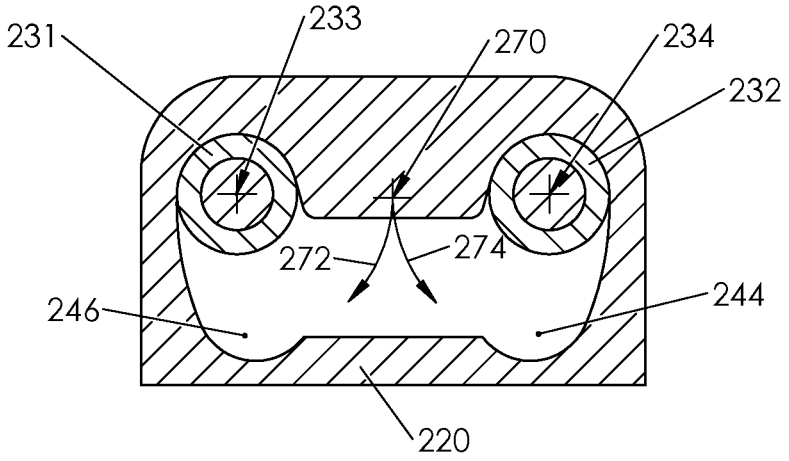

With reference now to FIG. 14B, sometimes a shelf 236 may not be included. In that case, pivot elements 231, 232 are generally fully seated in respective detents 240, 241 at a zero-turn configuration. Any micro-steering capability of truck 200 is therefore a function of compressibility of the bushing 220 in the detent region under compression by a pivot element 231, 232.

Figure 14C:
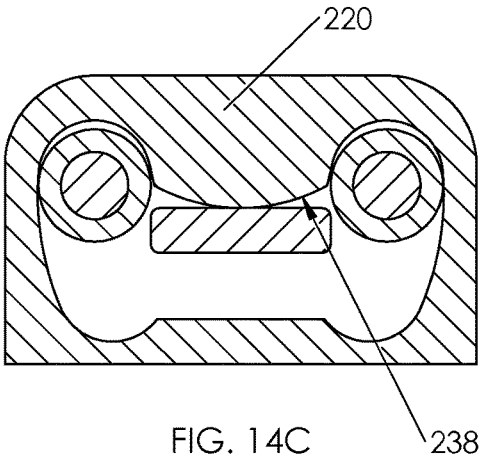
Figure 14D:
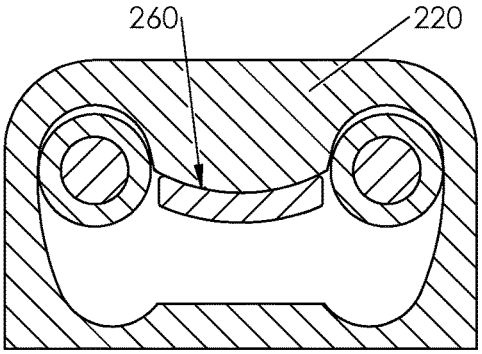
Figure 14E:
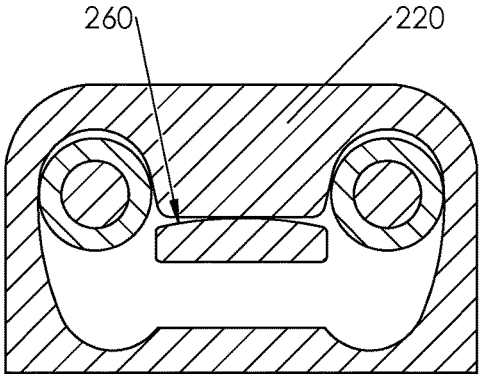

Still with reference to FIG. 14B, a mid-point between pivot elements 231, 232, generally indicated at 270, is an important distinguishing feature. The axle normal axis 146 passes through that pivot point. Arc 272 indicates the path traveled by the intersection of axle normal axis 146 with pivot point 270 during a turn in one direction. Arc 274 indicates the path traveled by the intersection of axle normal axis 146 with pivot point 270 during a turn in the other direction. FIGS. 14C through 14E illustrate some additional optional and workable shapes for surfaces 238 and 260.

Figure 15A:
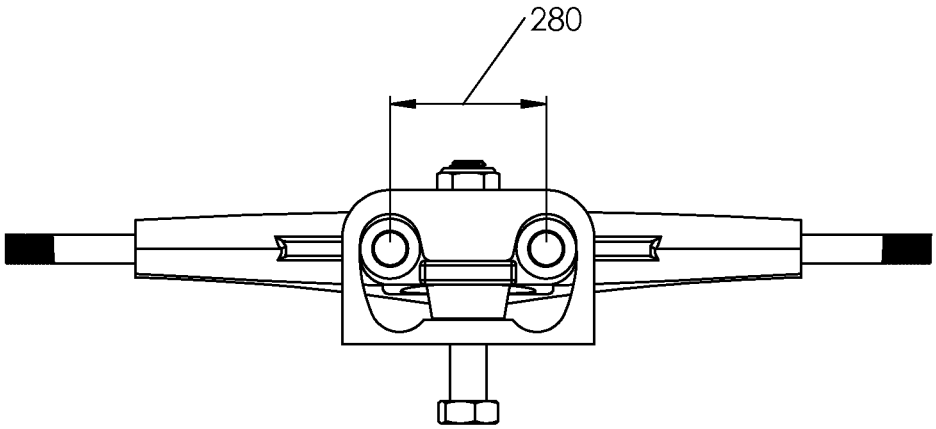
FIGS. 15A and 15B are views similar to FIG. 12, illustrating different pivot spacing workable in embodiments structured according to FIG. 3.
Figure 15B:
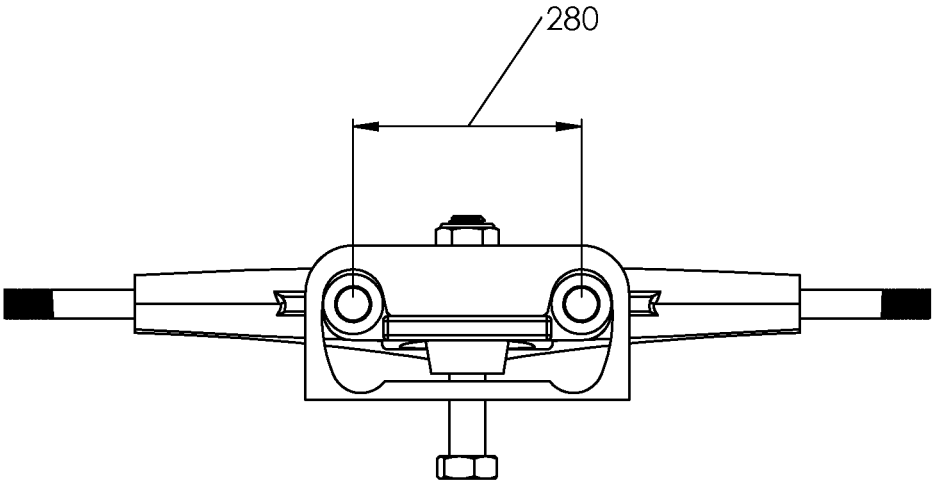
Figure 16:
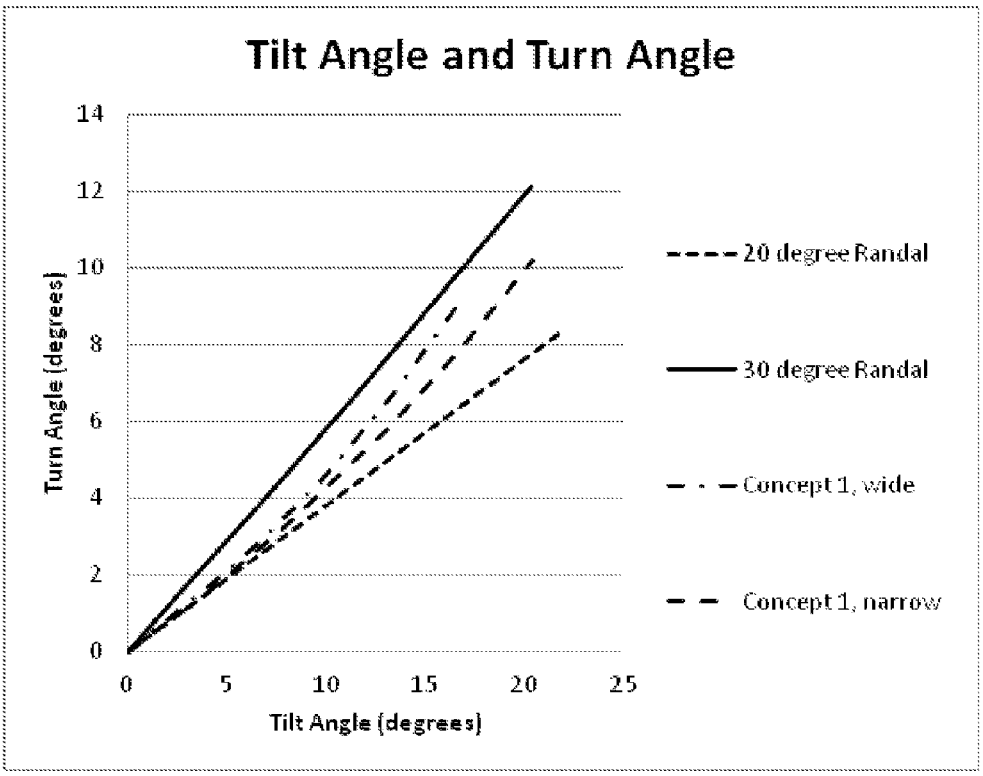
FIG. 16 is a plot comparing turn angle vs. tilt angle for certain embodiments of the invention against certain embodiments of prior art.

One design parameter that impacts on turn angle accomplished at a given tilt angle includes the spacing 280 between centers of pivot elements 231, 232. FIGS. 15A and 15B illustrate embodiments having different pivot axis spacing 280. FIG. 16 presents a plot showing the effect of pivot axis spacing 280 on a truck 200, compared to certain prior art trucks having different initial (and constant) action angles.

Figure 17A:
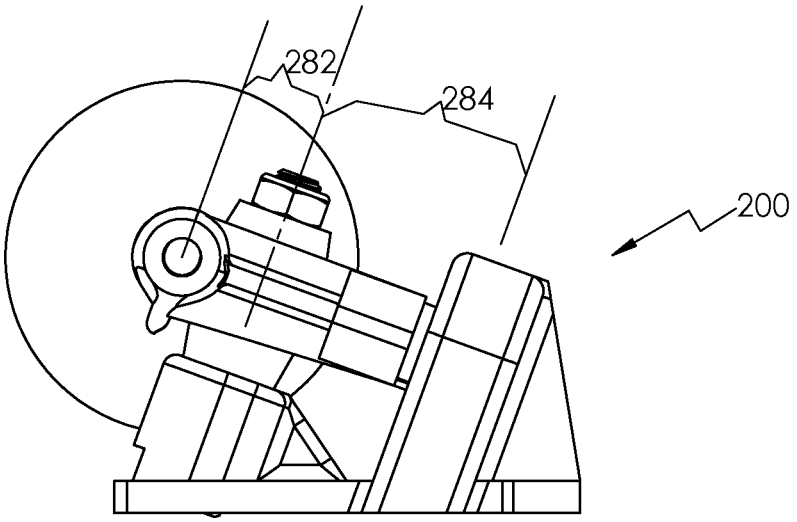
FIGS. 17A and 17B are side views illustrating certain design variables for embodiments structured according to FIG. 3.
Figure 17B:
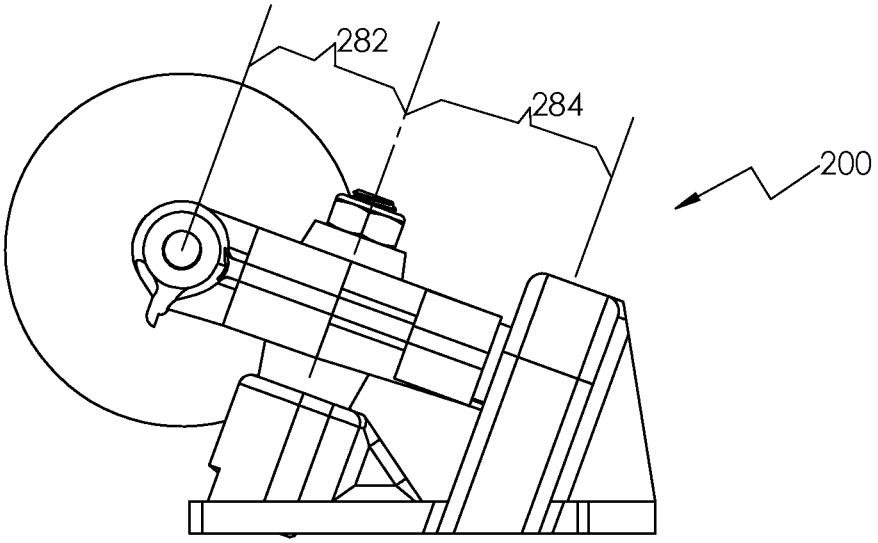
Figure 18:
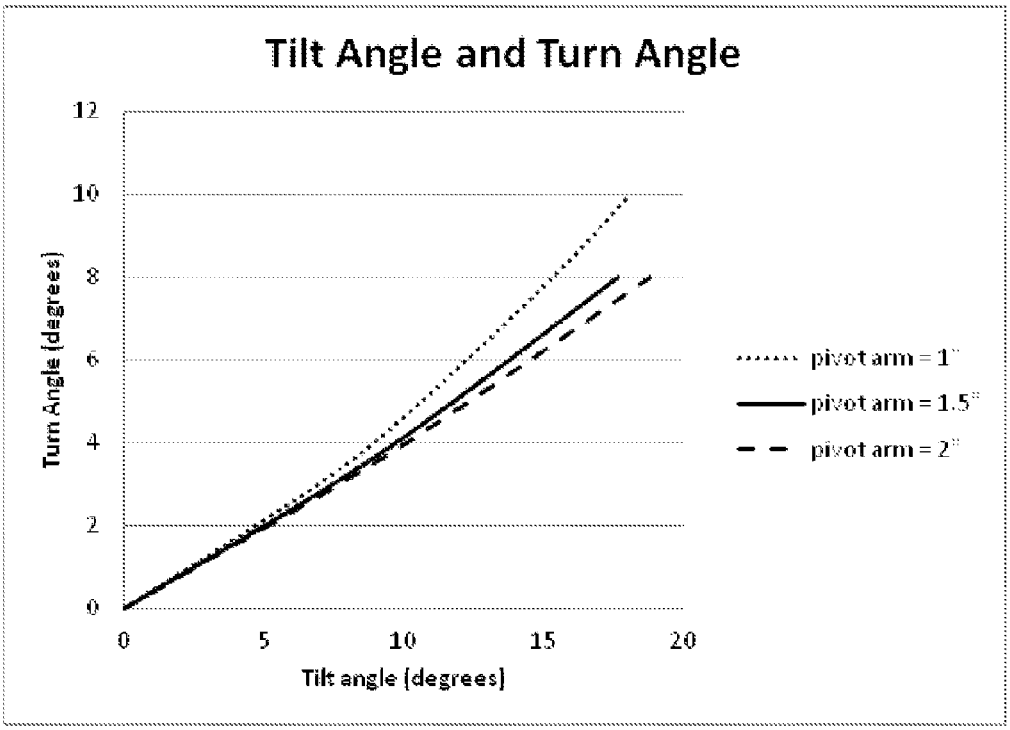
FIG. 18 is a plot showing the result of changes to pivot arm length on embodiments structured according to FIG. 3.

FIGS. 17A and 17B illustrate embodiments having different axle arm lengths 282, and different pivot arm lengths 284. FIG. 18 is a plot showing the trend in change of pivot arm length vs. tilt angle. The axle arm length does not change the tilt/turn angle curve, but does change the force needed to turn. The longer the axle arm, the harder it is to turn, because as the axle arm gets longer, there is more force on the pivot bushing 116, 118, due to leverage.

Figure 19A:
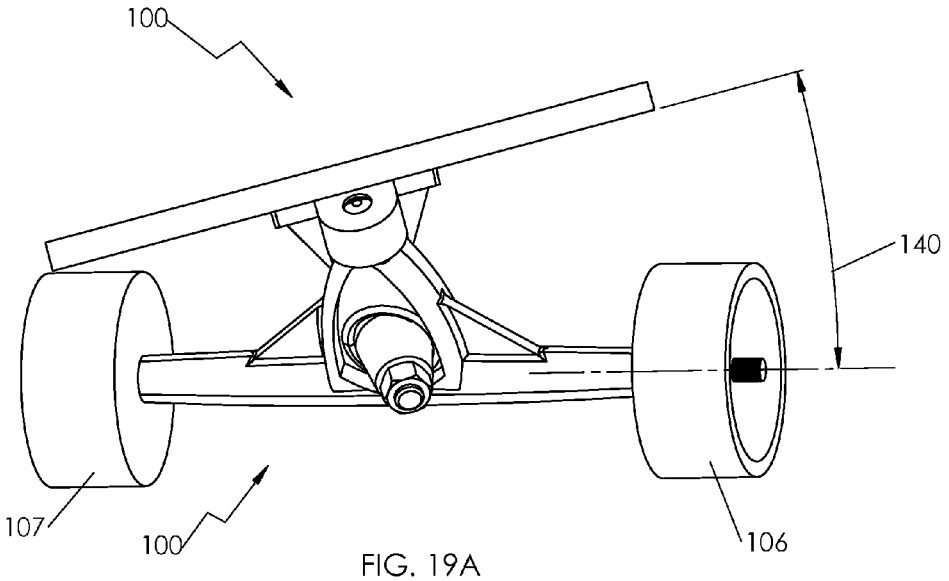
FIG. 19A PRIOR ART
FIGS. 19A and 19B are end views comparing tilt angle at wheel bite for a prior art embodiment in FIG. 19A (some elements being removed) and an embodiment in FIG. 19B structured according to FIG. 3, but with a riser installed to have the same initial board elevation as in FIG. 19A.
Figure 19B:
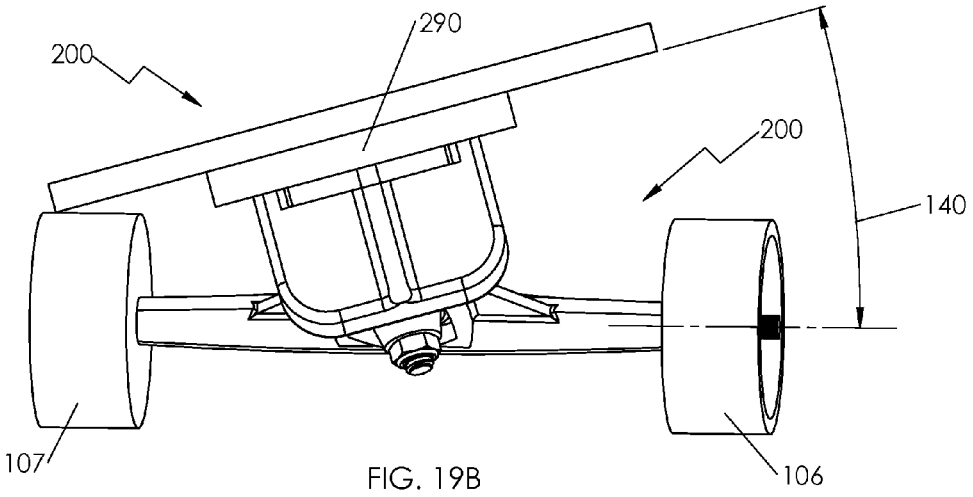
Figure 20A:
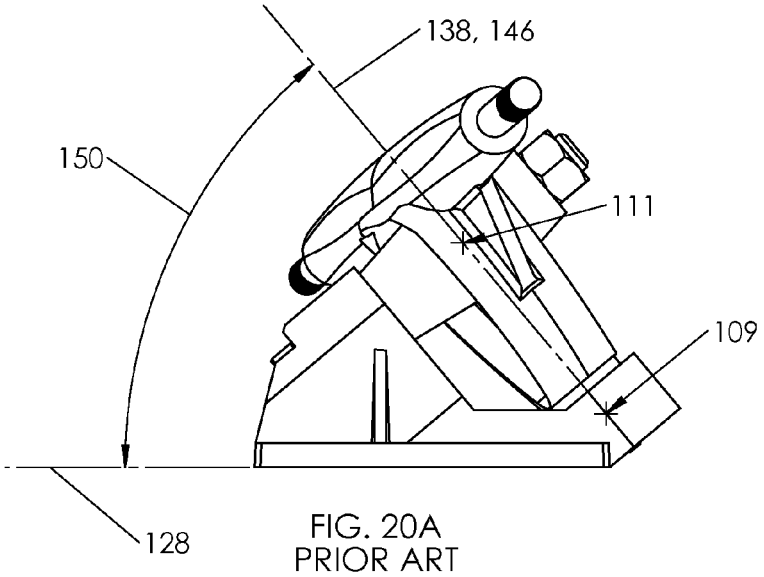
FIG. 20A PRIOR ART
FIGS. 20A-D are side views of embodiments 100, 160, 162, and 200, in a turn configuration and pointing out various axes of operation.
Figure 20B:
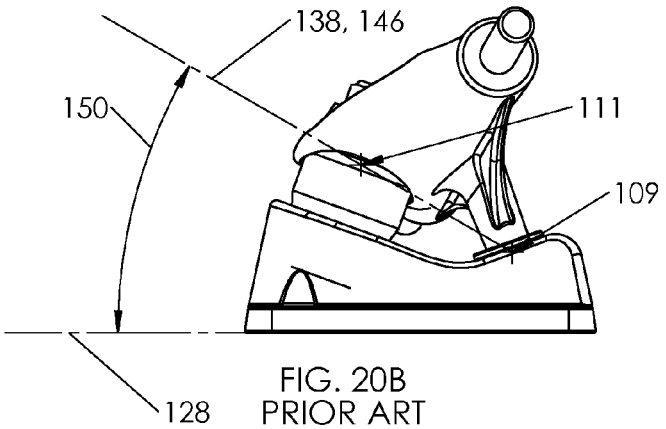
FIG. 20B PRIOR ART
Figure 20C:
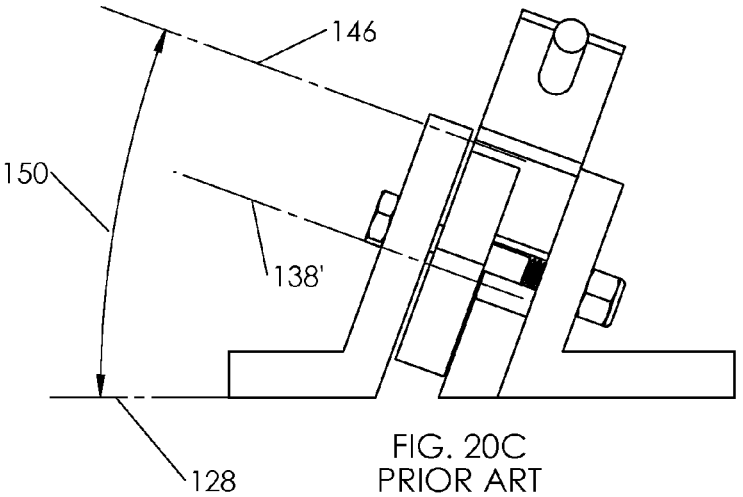
FIG. 20C PRIOR ART
Figure 20D:
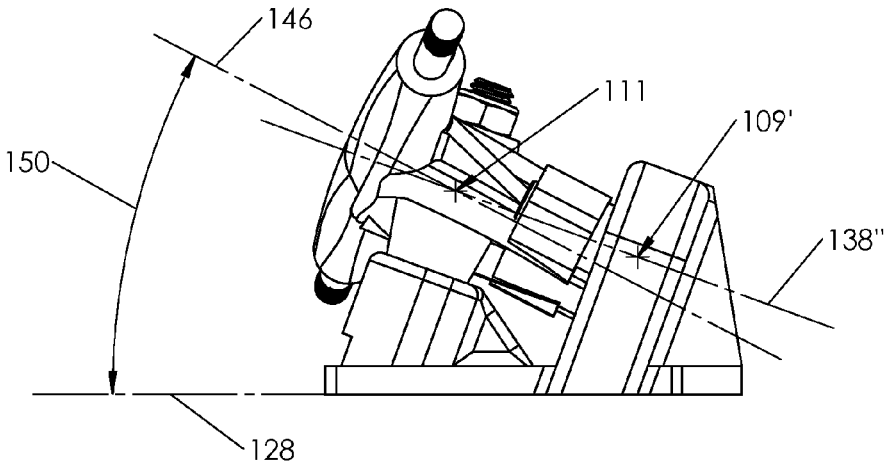
Figure 21A:
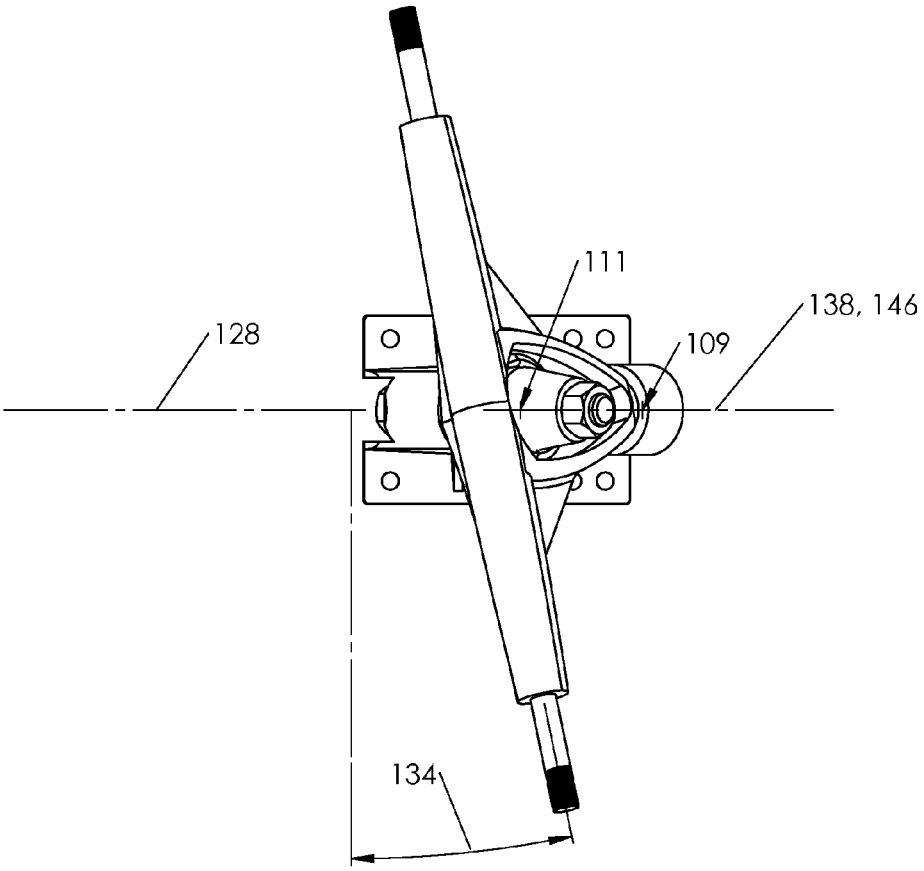
FIG. 21A PRIOR ART
FIGS. 21A-D are top views relative to the mounting surface, looking at the embodiments in FIGS. 20A-D, in the same turn configuration and pointing out various axes of operation.
Figure 21B:
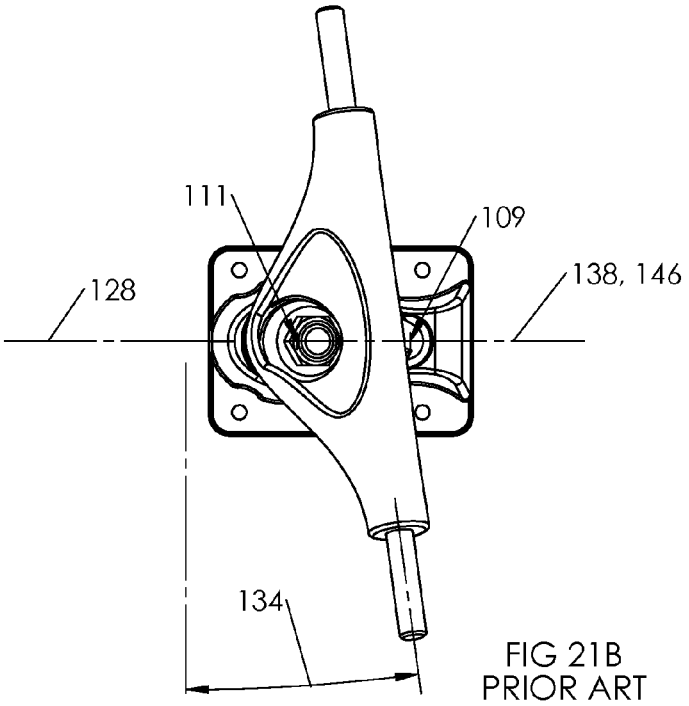
FIG 21B PRIOR ART
Figure 21C:
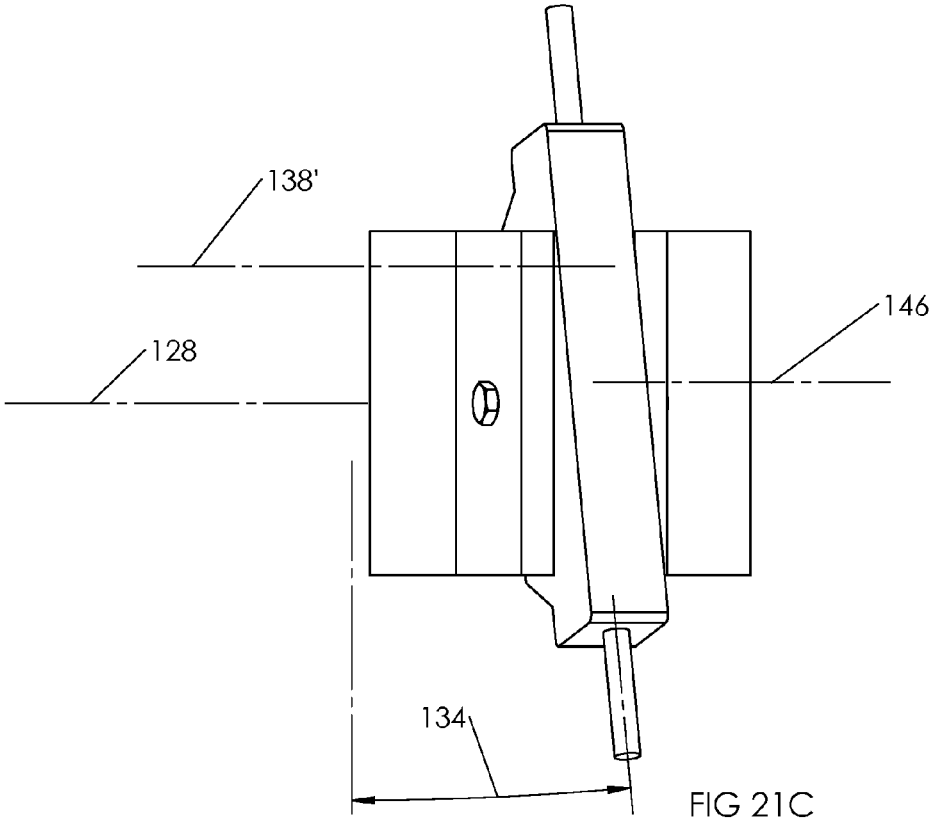
FIG 21C PRIOR ART
Figure 21D:
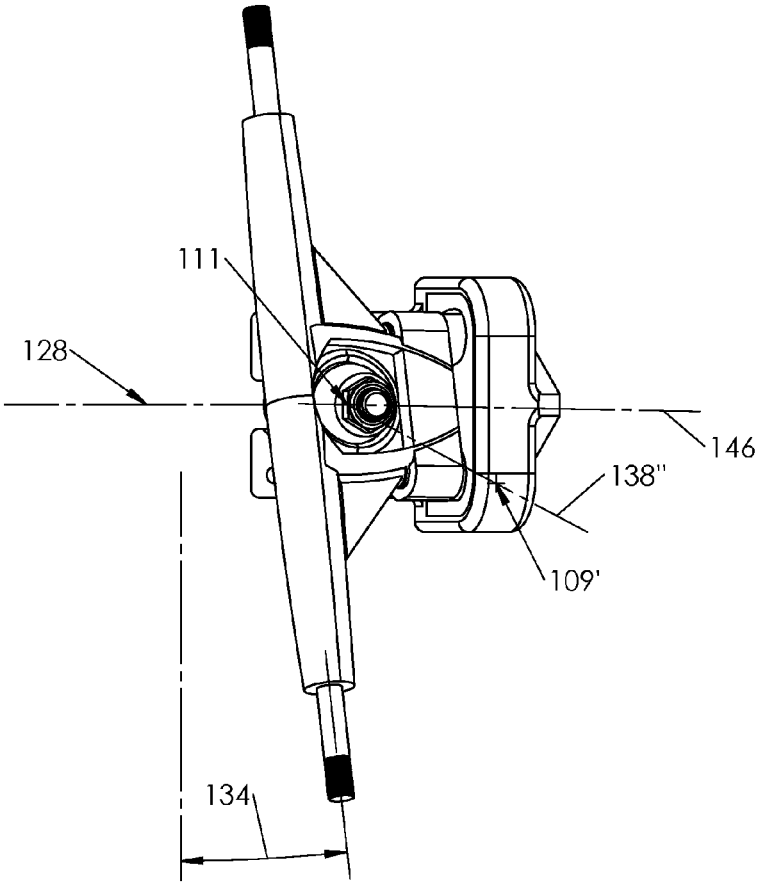
Figure 22A:
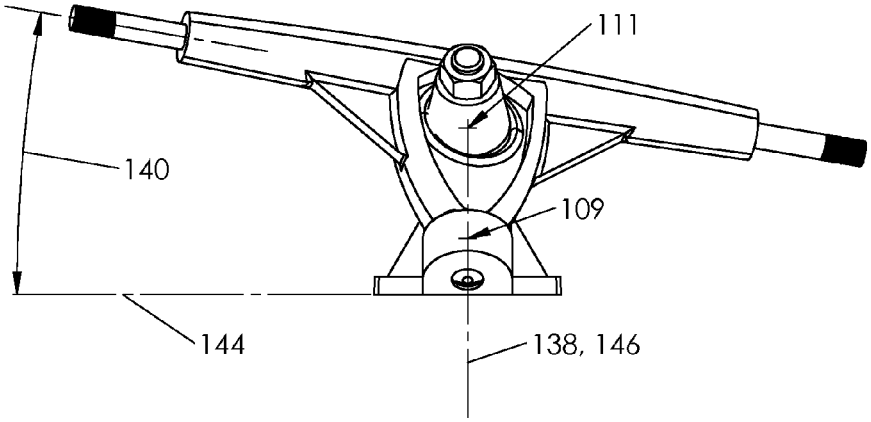
FIG. 22A PRIOR ART
FIG. 22A-D are front or outside views in perspective, looking at the embodiments in FIGS. 20A-D, in the same turn configuration and pointing out various axes of operation.
Figure 22B:
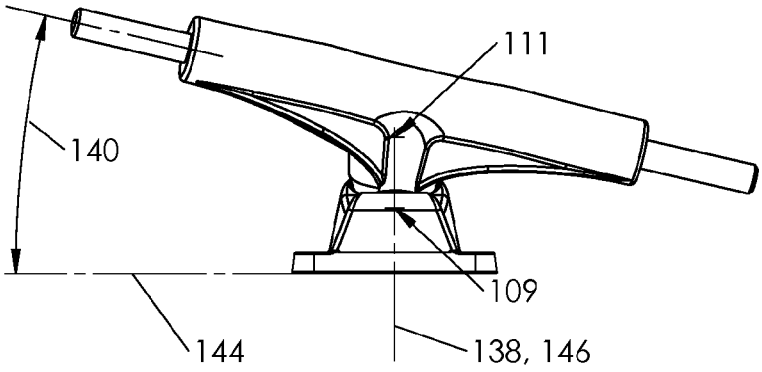
FIG 22B PRIOR ART
Figure 22C:
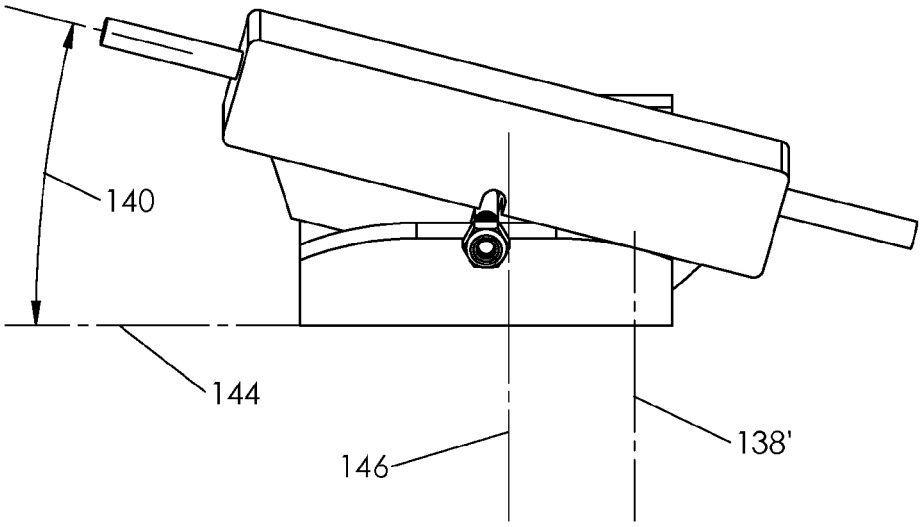
FIG 22C PRIOR ART
Figure 22D:
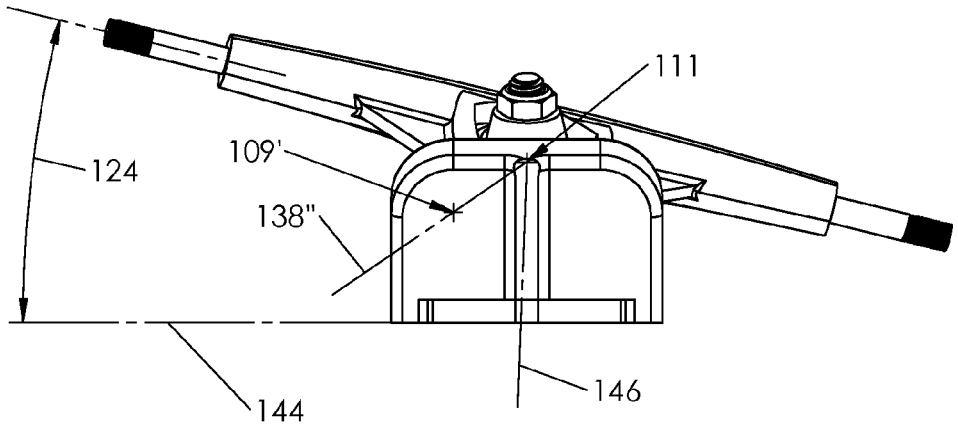

FIGS. 19A and 19B illustrate an increase in achievable board tilt angle 140 accomplished by an embodiment in FIG. 19B that is structured according to certain principles of the invention, and has the same initial action angle as the prior art truck illustrated in FIG. 19A. The embodiment in FIG. 19B permits an additional amount of board tilt angle 140 before the deck would interfere with a wheel. Note that a riser 290 is applied in FIG. 19B so that the initial deck height is the same between embodiments illustrated in FIGS. 19A and 19B.

FIGS. 20A-D through 22A-D illustrate embodiments of a skateboard truck 200 structured according to certain principles of the invention, and within the ambit of Concept 1, from different perspectives, and showing orientations of various distinguishing axes as compared to all known prior art embodiments. Note that FIG. 22C has removed the guidance plate 164 for clarity.

Figure 23:
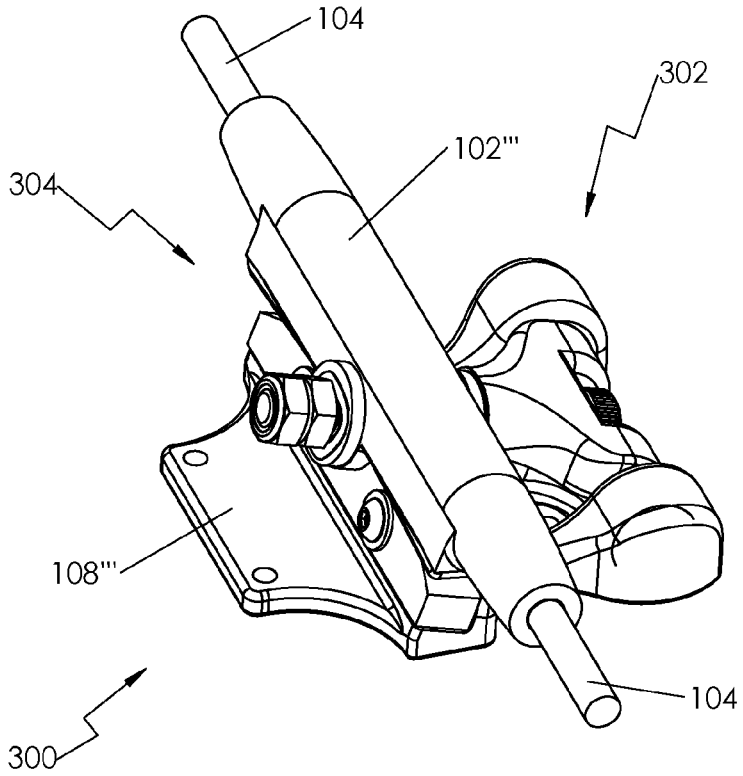
FIG. 23 is a view in perspective looking obliquely at the inside end of a second embodiment structured according to certain principles of the invention.
Figure 24:
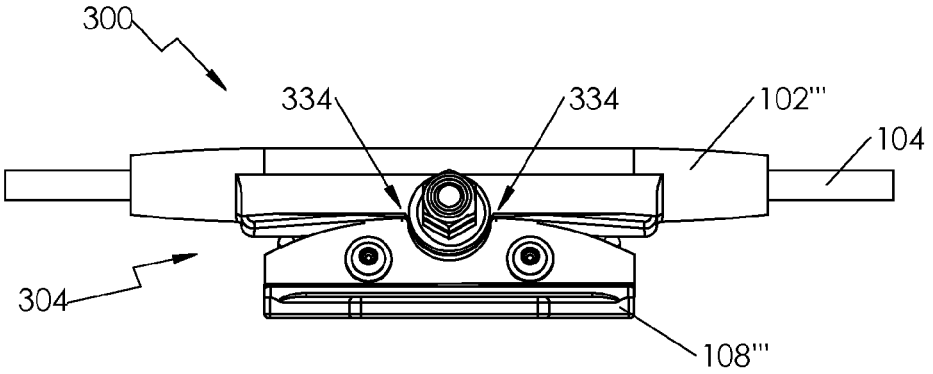
FIG. 24 is an inside end view of the embodiment in FIG. 23.
Figure 25:
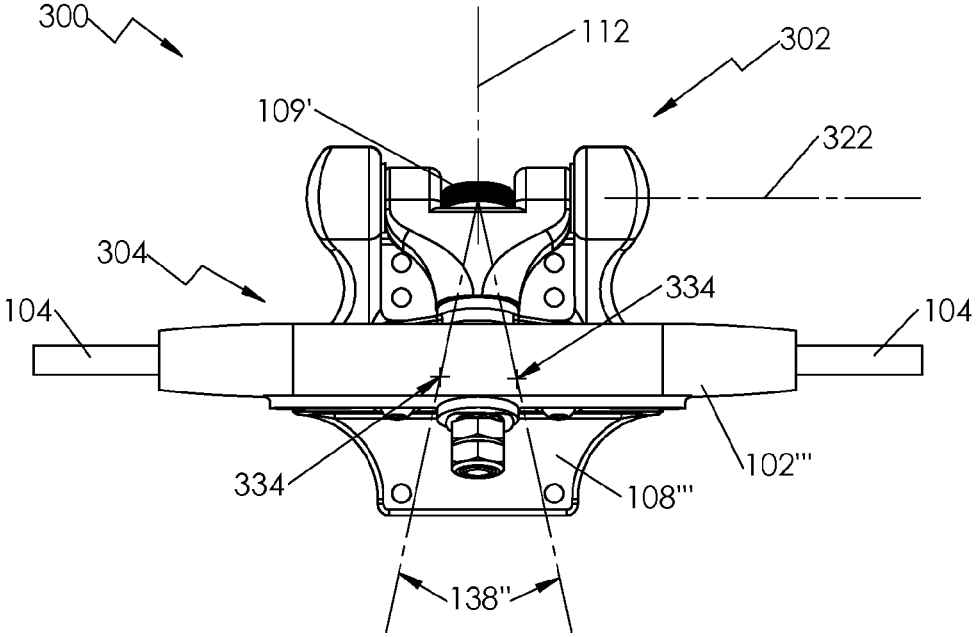
FIG. 25 is a top view of the embodiment in FIG. 23.
Figure 26:
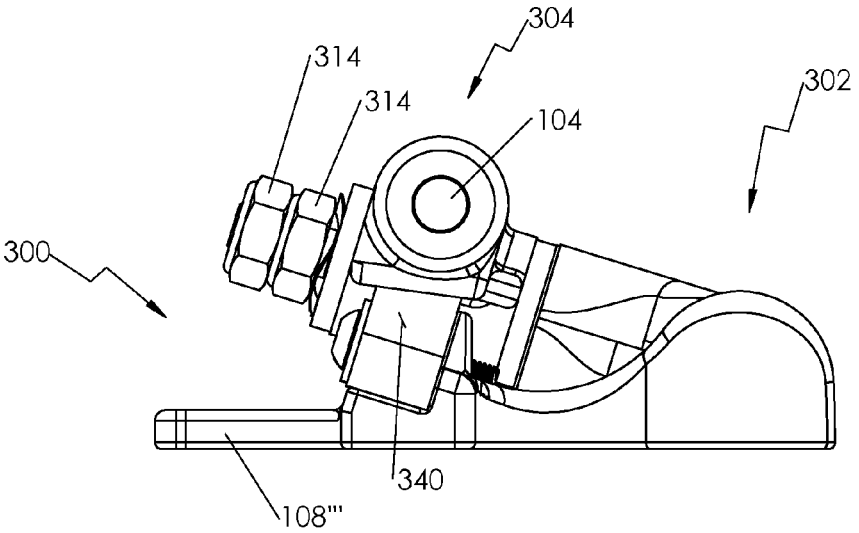
FIG. 26 is a side view of the embodiment in FIG. 23.

FIGS. 23-37 illustrate certain aspects of embodiments structured according to a second concept of the instant invention (Concept 2). An exemplary embodiment of a skateboard truck according to Concept 2 is indicated generally at 300 in FIG. 23. Truck 300 includes a static mechanism, generally 302, and a dynamic mechanism, generally 304. Elements typically included in the exemplary Concept 2 embodiment 300 are pointed out in FIG. 28. A hanger assembly, generally 308, includes a yoke 310, and a hanger 102'''. A kingpin 114 is held in registration inside a socket 312 (see FIG. 29) in yoke 310. The hanger 102''' is mounted to rotate about the center line 112 of the kingpin 114. It is currently preferred to include a pair of jam nuts 314 to secure the hanger assembly, and permit making adjustments to compression on the assembled elements. Typically, and as illustrated, bushings, and shims or washers, are included to provide an assembly 308 capable of surviving multiple cycles in their working environment.

Yoke 310 includes a pair of stub axles 320. The axles 320 are assembled for rotation about a pivot axis 322 in respective pivot bushing cups 324. Pivot axis 322 is typically characterized as a hanger pivot axis, because the hanger 102''' pivots about pivot axis 322. Pivot bushing cups 324 are held on assembly of the illustrated embodiment 300 by respective pivot sockets 326 formed in baseplate 108'''. The kingpin centerline 112 is desirably disposed normal to hanger pivot axis 322, to maintain turn symmetry in left and right directions.

Figure 28:
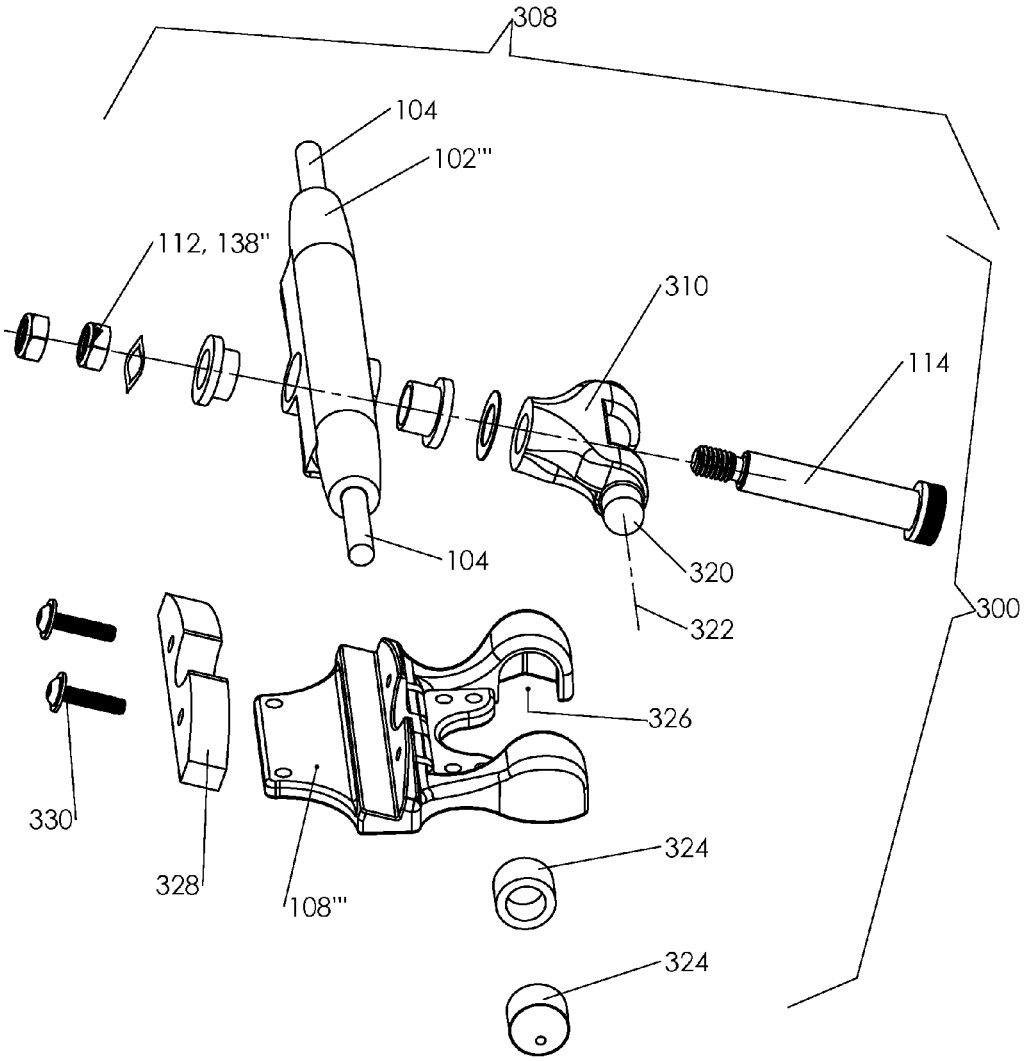
FIG. 28 is an exploded assembly view of the embodiment in FIG. 23.
Figure 29:
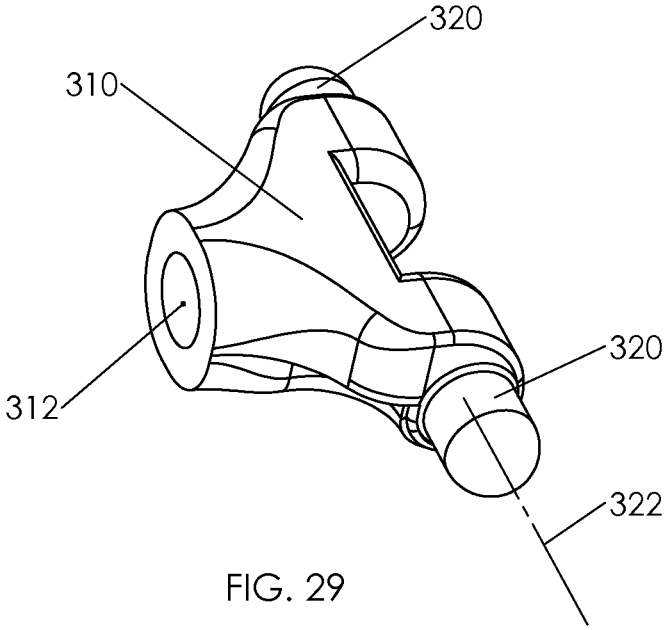
FIG. 29 is a view in perspective of an element of the embodiment in FIG. 23.
Figure 30:
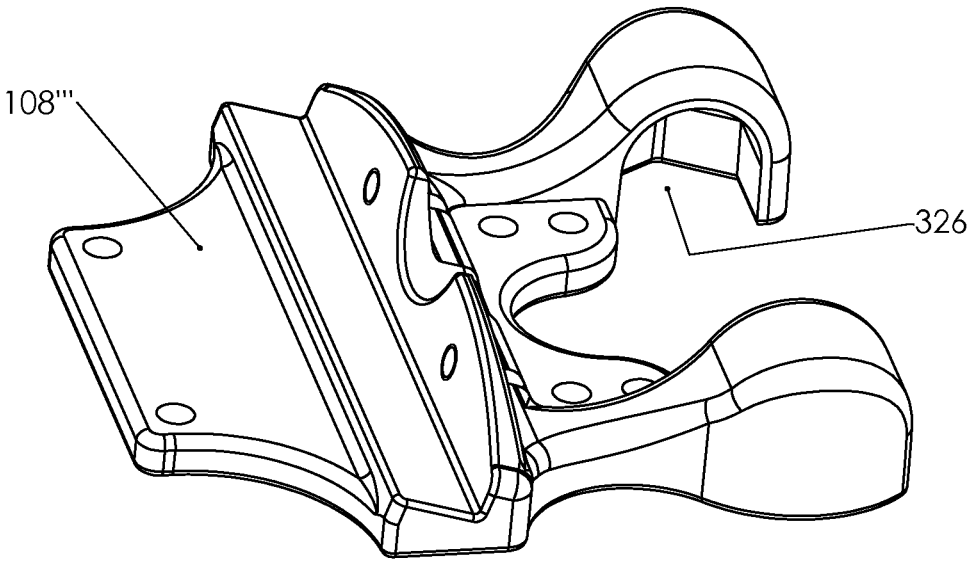
FIG. 30 is a view in perspective of another element of the embodiment in FIG. 23.

With particular reference to FIG. 28, a cam bushing 328 may be associated with baseplate 108'''. In the exemplary illustrated embodiment, cam bushing 328 is mounted to baseplate 108''' with a pair of Allen socket head screws 330. The shape of cam bushing is an important element for causing a turning response of the truck 300. Cam bushings may be interchanged to provide a particular desired turn response. Dynamic contact is made at a variable radius, from centerline 114, between the hanger 102''' and cam 328 as the hanger 102''' rotates about kingpin centerline 114. Alternatively, a cam bushing may be carried by hanger 102'''', or even equivalently, carried in combination between the baseplate and hanger.

Figure 27:
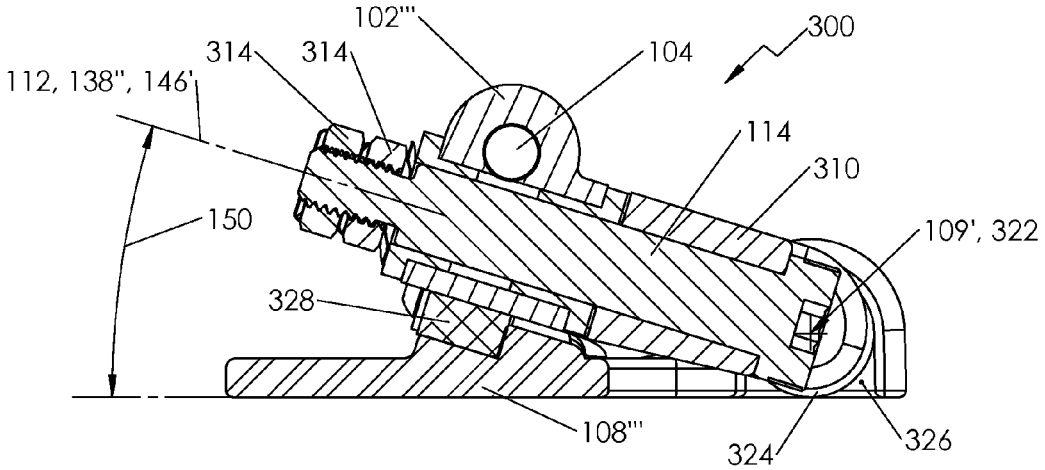
FIG. 27 is a cross-section view taken looking at a plane passing through the centerline and length axis of the embodiment in FIG. 23.

An operable static mechanism 302 is effective to define a static pivot point 109' (e.g. see FIG. 27) through which an instantaneous hanger rotation axis 138'' passes. In the illustrated embodiment 300, the instantaneous hanger rotation axis 138'' is coincident with kingpin centerline 114. The location of an exemplary static pivot point 109' is defined with reference to a pivot structure that perhaps may best be visualized also with reference to FIGS. 25 and 28. Pivot point 109' is a static pivot point, because it remains at a constant position with respect to baseplate 108'''. As seen in FIG. 27, in the illustrated embodiment 300, kingpin centerline 114 intersects hanger pivot axis 322 at pivot point 109'. However, that is not a requirement, and the location of pivot point 109' may be radially offset from (above or below) hanger pivot axis 322.

An operable dynamic mechanism 304 is effective to define at least two instantaneous pivot points through which hanger rotation axis 138'' may alternatively pass. In the illustrated embodiment 300, there are actually an infinite number of such pivot points. Dynamic mechanism 304 may be regarded as causing an oscillation of the hanger rotation axis 138'' about the static pivot point 109' responsive to active steering of the axle 104.

In the case of illustrated embodiment 300, the axle normal axis 146' is always coincident with the kingpin centerline 112. The instantaneous hanger rotation axis 138'' may be regarded as an axis in a coordinate system about which axis the hanger 102''' and axle 104 exhibit pure rotation. Therefore, the instantaneous hanger rotation axis 138'' is also coincident with kingpin centerline 112.

Figure 31:
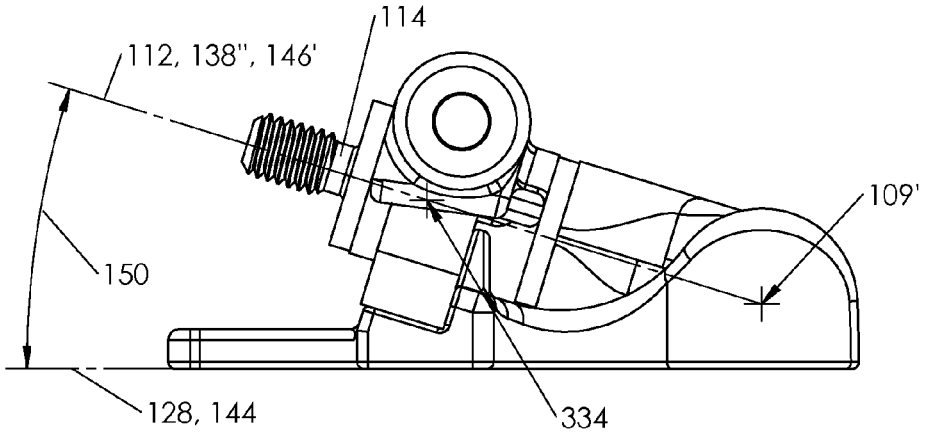
FIG. 31 is a side view of the embodiment in FIG. 23, with certain elements removed for clarity, and pointing out relevant axes and action angle at a zero-turn configuration.
Figure 32:
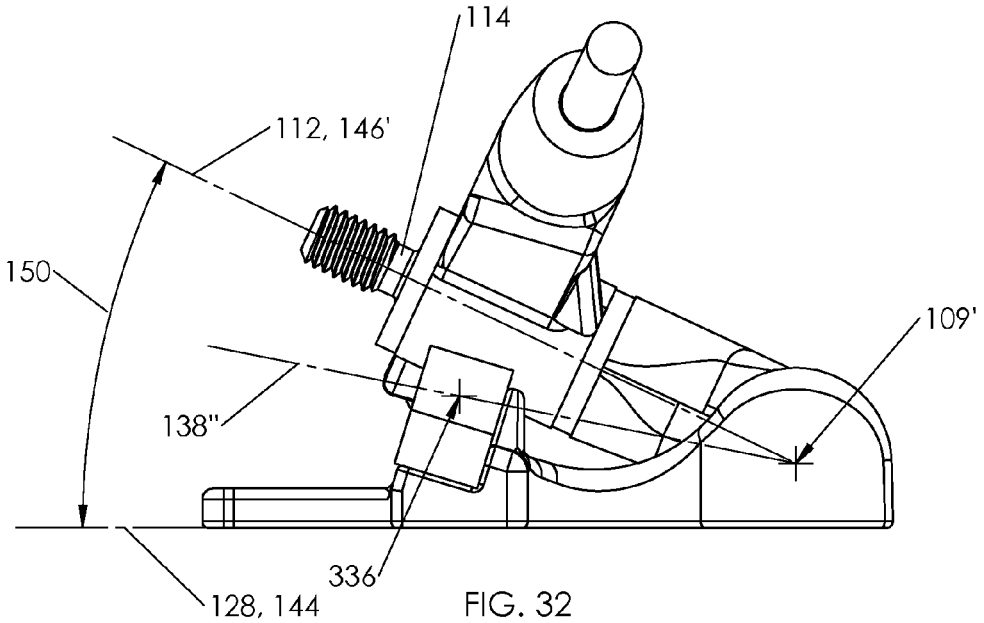
FIG. 32 is a side view of the embodiment in FIG. 23, with certain elements removed for clarity, and pointing out relevant axes and action angle at a sharp-turn configuration.

Recall that the action angle 150 is defined as the angle between a horizontal plane 144 and the axle normal axis 146' (perhaps best visualized for embodiment 300 in a side view, such as FIGS. 31 and 32). Recall also that the "hanger rotation axis" is defined as the pivot axis about which a hanger rotates with respect to its baseplate when change is made to a turn configuration. In FIG. 31, the instantaneous hanger rotation axis 138'' passes through static pivot point 109' and both of zero-turn contact points 334 (see FIG. 24). Interaction between hanger 102''' and contact points 334 desirably permits micro-turning of a truck 300.

Figure 33:
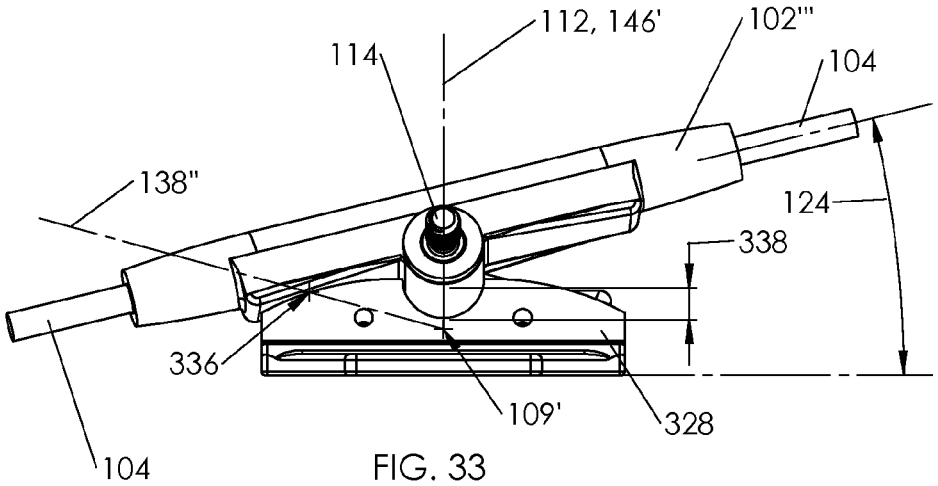
FIG. 33 is an inside end view of the embodiment in FIG. 23, with certain elements removed and at a sharp-turn configuration.
Figure 34:
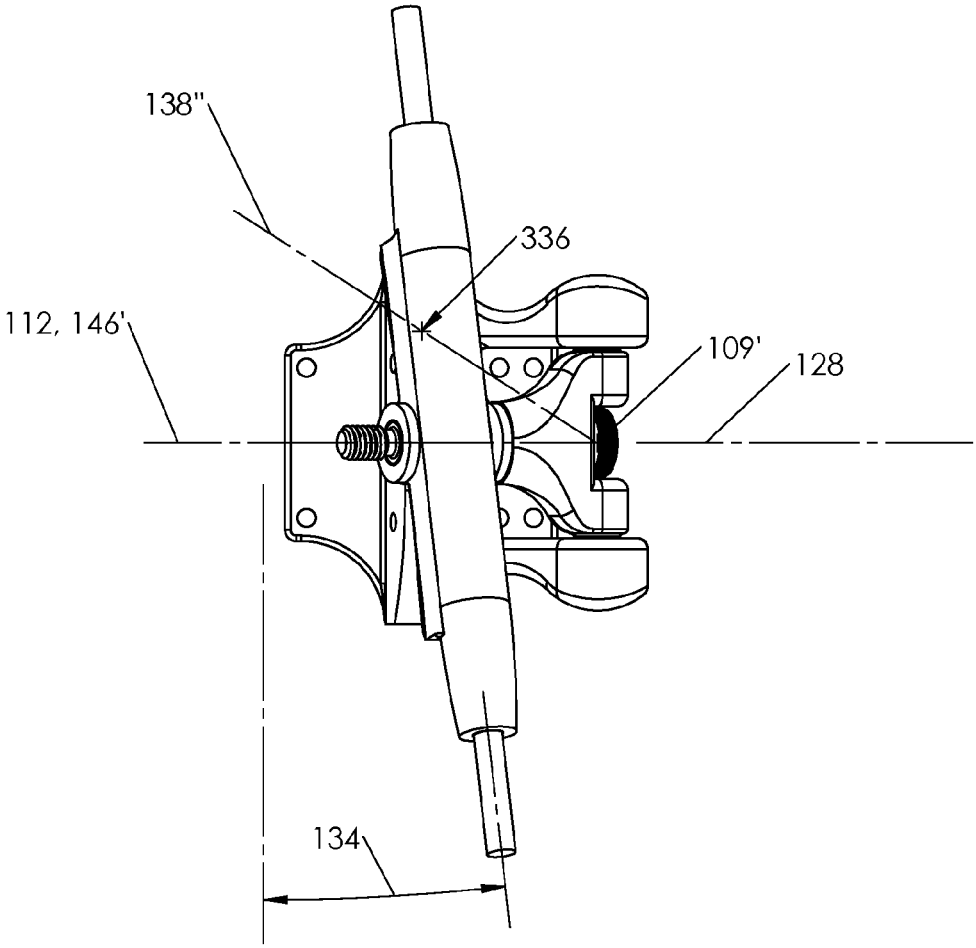
FIG. 34 is a top view from the perspective of a mounting surface on which the embodiment of FIG. 33 is anchored.
Figure 35:
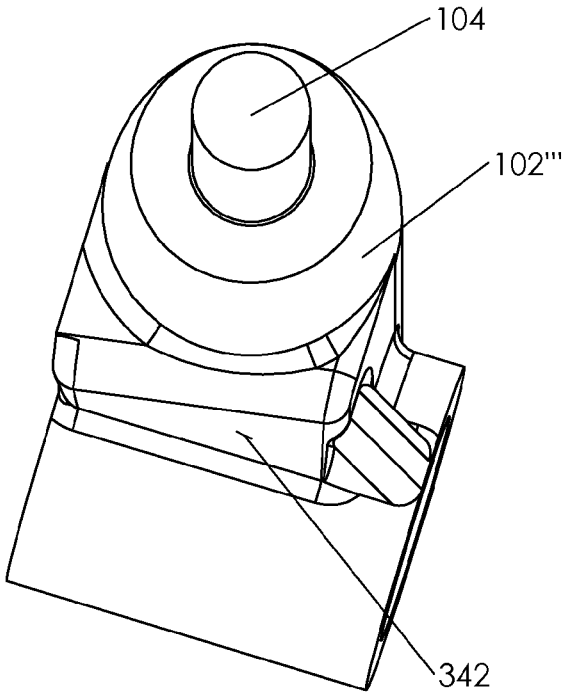
FIG. 35 is a side view of a workable hanger element for the embodiment in FIG. 23.
Figure 36:
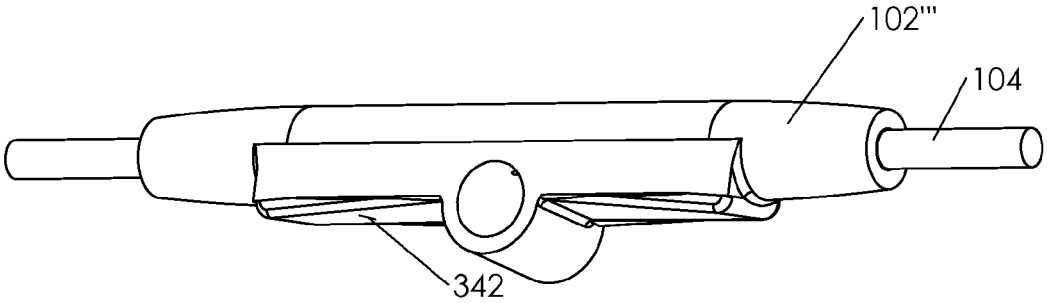
FIG. 36 is a view in perspective of the hanger element in FIG. 35.

In FIG. 32, the instantaneous hanger rotation axis 138'' passes through static pivot point 109' and sharp-turn contact point 336 (see FIG. 33). Note that in the sharp-turn configuration illustrated in FIG. 33, there is a space 338 formed between the hanger 102''' and cam bushing 328. Factors that influence the size of space 338 include the shape of cam 328 and its interaction with hanger 102''', and degree or amount of turn. Desirably, interaction of cam 328 and hanger 102''' forms rolling line contact, with the contact-line passing through the aforementioned contact point 336. Therefore, it is currently preferred to form interacting contact surfaces 340 and 342 (see FIGS. 27, 35 and 36) that are not flat.

It is desirable to provide means to resist separation of the hanger 102''' from contact with cam 328 (in addition to gravity). A variety of structures are within contemplation to do so. For non-limiting examples, a tension element (e.g. an O-ring or tension spring) may be disposed between the hanger and baseplate to urge the kingpin 114 to rotate about hanger pivot axis 322 toward the cam 328. Alternatively, a torsion spring element may be harnessed about axis 322 to accomplish the same objective. It is within contemplation to dispose either a compression element or a tension element for action at a radius from the axis 322 to accomplish the same objective. Further, a compression element may be installed between suitable anchor structure effective to directly urge hanger surface 342 toward can surface 340.

Figure 37:
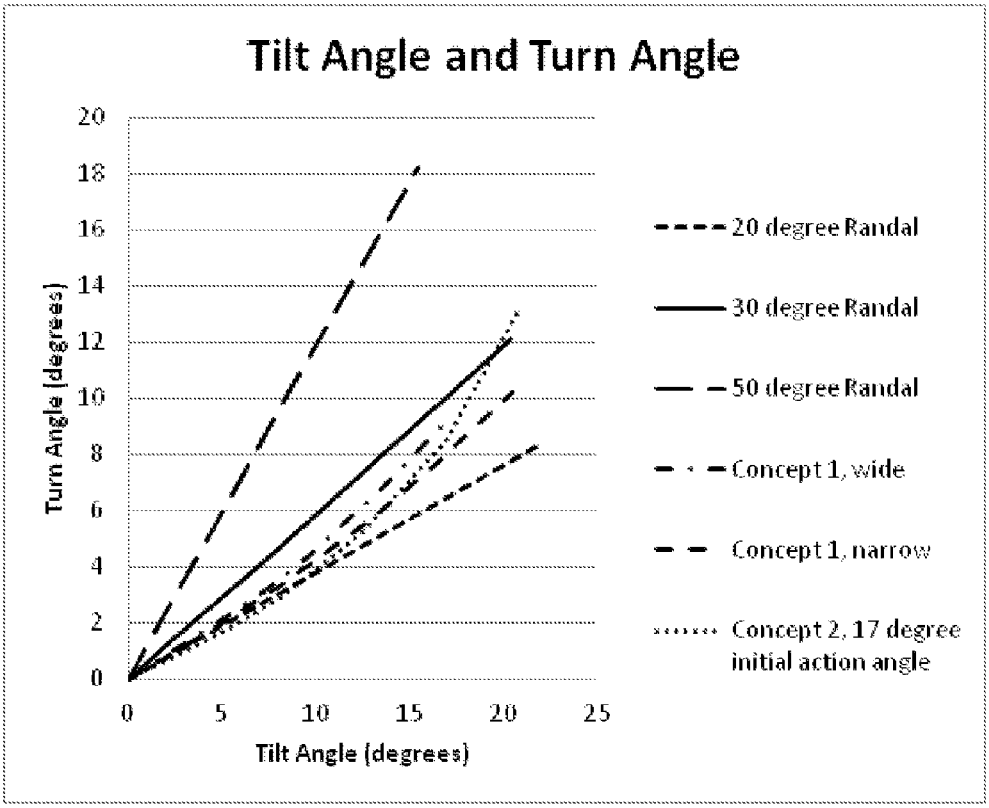
FIG. 37 is a plot comparing Tilt angle vs. Turn angle for certain embodiments structured according to certain principles of the invention against certain prior art embodiments.

FIG. 37 illustrates the effect of certain design parameters on turn performance of certain embodiments of the invention compared to certain commercially available embodiments. It may be seen that commercially available embodiments exhibit a linear relationship between tilt angle and turn angle. In contrast, that relationship is non-linear in embodiments of the invention. The general trend due to increase in pivot spacing for Concept 1 is to increase the non-linearity. Further, the plot of a Concept 2 embodiment shows that the initial action angle can be 17 degrees, and increase to more than 30 degrees, which encompasses slow steering response at low tilt angle, and rapid turn response at higher tilt angle. Therefore, embodiments according to the invention may offer benefits of a certain commercial embodiment at low tilt angle, and benefits of a different commercial embodiment at higher tilt angle.

While the invention has been described in particular with reference to certain illustrated embodiments, such is not intended to limit the scope of the invention. The described embodiments are to be considered as generally illustrative and not restrictive. All changes which come within the meaning and range of equivalency of the claims are to be embraced within their scope.

What is claimed is:

1. An apparatus, comprising:

an axle structured to span in a length axis direction between a pair of wheels such that said wheels are steered in unison by said axle, displacement of said axle being constrained by structure carried by a baseplate and effective to cause steering rotation of said axle about a dynamic hanger rotation axis; wherein:

during a turn maneuver between a maximum right turn position and a maximum left turn position:

said dynamic hanger rotation axis always passes through a static pivot point at a locus that is static with respect to a deck on which said baseplate is mounted;

said dynamic hanger rotation axis passes through at least two instantaneous pivot points that are not co-linear with said static pivot point; and roll of said baseplate about a roll axis causes a change in action angle of said axle during at least a portion of said turn maneuver.

2. The apparatus according to claim 1, wherein:

said axle is carried by a hanger; and support structure carried by said baseplate is arranged to cooperate with pivot structure associated with a proximal end of said hanger effective to cause displacement, relative to said baseplate, of an instantaneous pivot point as said axle moves between said maximum right turn position and said maximum left turn position.

3. The apparatus according to claim 2, wherein:

said support structure comprises a pivot bushing; and said pivot structure comprises a first pivot element and a second pivot element structured in harmony with said pivot bushing such that:

during change in a macro-turn in a first direction, said first pivot element defines a first instantaneous pivot point through which said dynamic pivot axis passes, and said second pivot element rotates around said first pivot element; and during change in a macro-turn in a second direction, said second pivot element defines a second instantaneous pivot point through which said dynamic pivot axis passes, and said first pivot element rotates around said second pivot element.

4. The apparatus according to claim 3, wherein:

said first and second pivot elements are journal mounted with respect to said hanger to permit their rotation about respective rotational axes.

5. The apparatus according to claim 4, wherein:

said first and second pivot elements are structured in harmony with cooperating first and second detents in a socket carried by said pivot bushing such that said first pivot element may register with said first detent to define a location of said first instantaneous pivot point, and said second pivot element may register with said second detent to define a location of said second instantaneous pivot point.

6. The apparatus according to claim 5, further comprising:

a third detent and a fourth detent, wherein:

said third detent is disposed to register with said second pivot element to define a maximum-turn configuration in said first direction; and said fourth detent is disposed to register with said first pivot element to define a maximum-turn configuration in said second direction.

7. The apparatus according to claim 3, wherein:

said pivot structure further comprises a shelf, at least a portion of said shelf being structured to cooperate with a portion of said pivot bushing effective to provide a micro-steering capability for said apparatus at an essentially zero-turn configuration of said axle.

8. The apparatus according to claim 1, wherein:

said apparatus is structured and arranged to cause an increase in action angle in correspondence with an increase in steering rotation of said axle.

9. The apparatus according to claim 1, wherein:

said apparatus is structured and arranged to cause a decrease in action angle in correspondence with an increase in steering rotation of said axle.

10. The apparatus according to claim 1, further comprising:

a kingpin anchored to said baseplate, said static pivot point being disposed on the centerline of said kingpin;

a hanger carrying said axle, said hanger being anchored to said baseplate effective to permit rotation of said hanger about said dynamic axis; and a turn-limiting mechanism effective to provide a hard turn stop at maximum left turn and maximum right turn configurations; wherein:

said turn-limiting mechanism is structured to avoid making contact with said kingpin.

11. The apparatus according to claim 1, wherein:

from the perspective of a surface on which said apparatus is rolled, said static pivot point is disposed between the centerline of said axle and a selected one of said instantaneous pivot points.

12. The apparatus according to claim 1, wherein:

from the perspective of a surface on which said apparatus is rolled, said static pivot point is disposed on the opposite side of the centerline of said axle from a selected one of said instantaneous pivot points.

13. The apparatus according to claim 1, wherein:

said baseplate is coupled to a hanger that carries said axle; and from the perspective of a surface on which said apparatus is rolled, said static pivot point is disposed closer to the inside end of said baseplate than a selected one of said instantaneous pivot points.

14. The apparatus according to claim 1, wherein:

said baseplate is coupled to a hanger that carries said axle; and from the perspective of a surface on which said apparatus is rolled, said static pivot point is disposed closer to the outside end of said baseplate than a selected one of said instantaneous pivot points.

15. The apparatus according to claim 1, further comprising:

a hanger carrying said axle;

a pair of spaced apart hanger pivot anchors defined by structure carried by said baseplate, said pivot anchors being effective to define a hanger pivot axis extending there-between;

a yoke disposed to pivot around said hanger pivot axis; and a kingpin held by said yoke to dispose the centerline of said kingpin normal to said hanger pivot axis; wherein:

said hanger is structured to rotate about said centerline of said kingpin while maintaining dynamic contact with said baseplate.

16. The apparatus according to claim 15, further comprising:

means to urge dynamic contact between said hanger and said baseplate in the absence of gravity-enforced contact.

17. An apparatus, comprising:

a hanger carrying an axle, said axle being structured to span in a length axis direction between a pair of wheels such that said wheels are steered in unison by said axle;

a baseplate coupled to said hanger effective to permit rotation of said hanger about a dynamic hanger rotation axis;

a static mechanism structured to enforce a substantially static pivot point at a locus through which said dynamic hanger rotation axis passes during turning operation of said apparatus; and a dynamic mechanism structured to cause said dynamic hanger rotation axis to pass through a plurality of dynamic hanger pivot points during said turning operation; wherein:

roll of said baseplate about a roll axis is operable to cause a steering rotation of said axle and a change in the action angle of said axle, such that a change in said action angle during a turn maneuver between maximum left turn and right turn configurations, measured relative to said baseplate, is only a function of roll of said baseplate.

18. The apparatus according to claim 17, wherein:

said dynamic turning mechanism is structured and arranged to cause a nonlinear change in turn angle responsive to change in tilt angle of said baseplate.

19. The apparatus according to claim 17, wherein:

said dynamic turning mechanism is structured and arranged to cause an increase in action angle in correspondence with an increase in steering rotation of said axle.

20. An apparatus, comprising:

a hanger carrying an axle, said axle being structured to span in a length axis direction between a pair of wheels such that said wheels are steered in unison by said axle; and a baseplate coupled to said hanger effective to permit rotation of said hanger about a dynamic hanger rotation axis such that tilting said baseplate around a conveyance roll axis can cause a change in action angle of said apparatus and a change in action angle during a turn maneuver between maximum left turn and right turn configurations is only a function of tilting said baseplate; wherein:

said dynamic hanger rotation axis passes through a static pivot point.

* * * * *